US006696230B2

(12) United States Patent
Kokeguchi et al.

(10) Patent No.: US 6,696,230 B2
(45) Date of Patent: Feb. 24, 2004

(54) COLOR IMAGING FORMING METHOD AND DIGITAL IMAGE FORMING METHOD

(75) Inventors: Noriyuki Kokeguchi, Kokubunji (JP); Hiroyuki Hoshino, Hachioji (JP); Hiromoto II, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/397,503

(22) Filed: Mar. 26, 2003

(65) Prior Publication Data

US 2003/0203324 A1 Oct. 30, 2003

(30) Foreign Application Priority Data

Apr. 4, 2002 (JP) ..... 2002-102316

(51) Int. Cl.[7] ..... G03C 7/388

(52) U.S. Cl. ..... 430/394; 430/351; 430/434

(58) Field of Search ..... 430/394, 351, 430/434

(56) References Cited

U.S. PATENT DOCUMENTS 6,245,499 B1 * 6/2001 Suzuki et al. ..... 430/619

OTHER PUBLICATIONS

Abstract JP 2000075453 A, Mar. 2000.*

* cited by examiner

*Primary Examiner*—Hoa Van Le
(74) *Attorney, Agent, or Firm*—Muserlian, Lucas and Mercanti

(57) ABSTRACT

A color image forming method is disclosed, comprising exposing a silver halide color photographic material and developing the exposed photographic material at 43 to 180° C. to form a color image, wherein when the photographic material is exposed so that the light-sensitive layer has a transmission density of a minimum density plus 0.1, the light-sensitive layer comprises dye-clouds having an average diameter of 3.0 to 20.0 $\mu$m. There is also disclosed a digital image forming process, wherein image recording information of the photographic material which was formed by use of the color image forming method is converted to digital image information through an image sensor.

33 Claims, No Drawings

COLOR IMAGING FORMING METHOD AND DIGITAL IMAGE FORMING METHOD

FIELD OF THE INVENTION

The present invention relates to a color image forming method of silver halide color photographic material and a digital image forming method by the use thereof.

BACKGROUND OF THE INVENTION

Silver halide photographic light-sensitive materials (hereinafter, also denoted simply as photographic materials) are used as a recording material which is simple and low in cost but nonetheless capable of providing high quality images. These materials have greatly contributed to the advancement of industry and culture, and have become indispensable material.

Silver halide color photographic material such as color negative film, after exposure, is subjected to color development to form yellow (Y), magenta (M) and cyan (C) dye images along with formation of silver images, which is subsequently subjected to bleaching to bleach the silver images to silver halide. The thus formed silver halide becomes a soluble silver complex and is removed from the photographic material. The photographic material is further subjected to a stabilization treatment to wash out any residual fixing agent and to clean the photographic material.

In the universally employed processing for color negative film (e.g., Process C-41 or CNK-4), as described above, the photographic material is subjected to many processing steps, often resulting in problems such that the processing time becomes relatively lengthy and the processing apparatus becomes larger. There also arise problems such that water is needed to make processing solutions and its dissolution work is cumbersome, handling the relatively high pH solution is hazardous, it is troublesome to control exhausted processing solutions after processing, and disposal of processing effluents is not preferable for environmental protection.

The foregoing problems have are less of problem in large volume labs. Recently, on-site processing, so-called minilab has increased to enhance convenience of color film processing, for which a compact and rapidly accessible photographic processing system is desired, which can be handled even by a non-specialist or part-time workers and is simple, safe and friendly to the environment. Further thereto, to achieve further enhancement of convenience of color films, it is also desired to introduce a photographic processing system into a place such as convenience stores, where a photographic processing apparatus has not been provided and therefore, development of a compact and rapidly-accessible photographic processing system which functions in a simple and safe manner without discharging effluent but still is friendly to the environment is desired to replace conventional processing systems. Various attempts have been made in response to such a desire. For example, JP-A Nos. 9-325463 and 10-62938 (hereinafter, the term, JP-A refers to unexamined and published Japanese Patent Application) disclose a technique, in which a photographic material is superposed onto a processing element in the presence of water and the material is then heated to form images. Such a technique enables easy processing of a photographic material, but the photographic material used therein is a specific one which occludes a color developing agent and conventional color films are not applicable thereto.

Nowadays, in this so-called digitization age, it is common that image information is optically read out from photographed and processed film to form images, using an image sensor such as film scanner, the images are converted to electric signals and digitized, thereby, the image information can be stored as signals and subjected to computer processing to obtain dye images using a photo-copy or a hard copy. In such an imaging process is generally performed an image input by using a digital camera provided with a solid-state image sensor as well as conventional silver salt photographic films (such as color negative film). However, high quality images cannot be obtained by low-priced digital cameras which are relatively low in pixel density and narrow in dynamic range and which are rather expensive relative to a conventional lens-fitted film. The integrated usability of silver halide photographic material system is still high.

Various attempts have been made in response to such demand. For example, JP-A Nos. 9-325463 and 10-62938 (hereinafter, the term, JP-A refers to unexamined Japanese Patent Application Publication) disclose a technique, in which a photographic material is superposed onto a processing element in the presence of water and the material is then heated to form images. JP-A Nos. 11-184055 and 11-65054 disclose a technique, in which a developer solution containing a color developing agent is coated or sprayed onto a photographic material to form dye images. JP-A No. 2001-166449 discloses a method of processing photographic film packed in a thrust film cartridge using a developing apparatus having a washing mechanism and a donor web placed along the processing route to conduct coating of the processing solution. JP-A No. 1-161236 discloses an increase of the swelling speed of image receiving material of a diffusion transfer photographic material by a factor of 0.2 to 1.5 of photographic material photographic material; and JP-A 9-325463 discloses processing a developer incorporated photographic material by a processing member exhibiting a higher swelling degree for water than the photographic material. JP-A No. 2001-350240 discloses a photographic material comprising a silver halide emulsion layer having a pAg of 4.0 to 8.5, and containing tabular silver halide grains having an aspect ratio of 5 or more and accounting for at least 60% of the grain projected area; JP-A No. 2001-350236 discloses a processing method to achieve a high developed silver density; and JP-A 2002-31867 discloses a processing method, in which the number of development initiating points per silver halide grain is 3.0 or more at the time of completion of color development. As a result of detailed study of the foregoing disclosures by the inventors of this application, it was proved that processes of developed silver formation, dye formation and transformation to an optical density were not efficiently achieved in the course of rapid processing by the foregoing disclosed techniques, producing common problems in that these processes greatly affected stability of photographic material, specifically, process variation of photographic materials differing in keeping conditions prior to exposure.

Further, in processed silver halide color photographic materials as described above, valuable resources such as silver are disposed or a part thereof is recovered after processing so that the reuse ratio thereof is still low. Considering further exhaustion of finite resources such as silver in future, there is desired a new method for reuse of resources.

SUMMARY OF THE INVENTION

In view of the foregoing problems, the present invention was achieved. Thus, it is an object of the invention to provide a method for forming a color image with silver halide color photographic material exhibiting enhanced sensitivity, suitability for rapid access and superior process stability even after being kept over a long period of time, an inexpensive digital image forming process by use thereof and a method for utilizing resources.

The foregoing object was accomplished by the following constitution:

1. A method of forming a color image comprising:
   imagewise exposing a silver halide color photographic material comprising a support having thereon at least one silver halide light-sensitive layer containing silver halide grains and a dye-forming coupler and
   subjecting the exposed photographic material to color development at a developing temperature of 43 to 180° C. to form a color image,
   wherein when the photographic material is exposed so that the developed light-sensitive layer has a transmission density of a minimum density plus 0.1, the developed light-sensitive layer forms dye-clouds having an average diameter of 3.0 to 20.0 μm.;
2. A digital image forming method, wherein image recording information of the photographic material which was formed by use of the color image forming method described above is converted to digital image information via an image sensor;
3. Resource utilization method comprising utilizing the processed silver halide color photographic material as a recovered resource.

DETAILED DESCRIPTION OF THE INVENTION

The ISO speed defined in this invention is determined in accordance with American National Standard (ANSI) PH2.27 "Determination of ISO Speed of Color Negative Film used in Still Photograph". Silver halide color photographic materials usually differ in image quality, depending on color developing conditions (e.g., chemical composition and pH of the processing solution used, temperature, time, stirring condition, exhaustion state, etc.) and vary in absolute value of the ISO speed. In this invention, the photographic material and the processing applied thereto are regarded as a set and the ISO speed can be determined from sensitometry in each set (curve comprised of abscissa as the exposure H and ordinate as the density D), in accordance with descriptions of the above-described PH2.27. In the photographic material relating to this invention, the higher ISO speed results in enhanced effects of this invention, and an ISO speed of 250 or more is preferred and an ISO speed of 800 or more is specifically preferred. Thus, in one preferred embodiment of the invention, the photographic material exhibits an ISO speed of at least 800.

One aspect of this invention is a color image forming method comprising the steps of exposing a silver halide color photographic material which comprises a support having thereon at least one silver halide light-sensitive layer containing a dye-forming coupler and then color-developing the exposed photographic material at a relatively high temperature of 43 to 180° C., wherein when the light-sensitive layer is exposed so as to have a transmission density of a minimum density plus 0.1, the light-sensitive layer comprises dye-clouds having an average diameter of 3.0 to 20.0 μm, i.e., at least a light-sensitive layer which has been exposed and color-developed comprises dye-clouds formed at a site giving a transmission density of a minimum color density plus 0.1 have an average diameter of 3.0 to 20.0 μm.

The dye clouds are commonly known in the photographic art, for example, as described in U.S. Pat. No. 6,505,977 (col. 2, line 4–7). Thus, in general, the silver halide color photographic material is exposed and developed with a color developer to form a dye image. Thus, the developer chemically reacts with the exposed silver halide to produced elemental silver grains in each silver halide light-light sensitive layer of the photographic material. The metallic silver forms a silver image within the layer. The by-product of the chemical reaction combines with the dye-forming coupler contained in the layer to create a dye cloud around each developing silver halide grain to form a dye image. Thus, the dye image is formed upon coupling reaction of the coupler, which is dispersed around the silver halide grain in the form of fine oily droplets of ca. 0.1 μm, and a developing agent oxidized by the silver halide. As a result, there is produced the distribution of fine oil droplets colored by the coupler dye, which is called "dye cloud".

The average diameter (in μm) of dye-clouds formed after developing, as defined in this invention can be determined by microscopic observation using a high power optical microscope. The dye-clouds are observed from the direction vertical to the support of the developed photographic material. The diameter of a dye-cloud (expressed in μm) is defined as an equivalent circle diameter of the projected area of the dye-cloud, i.e., the diameter of a circle having an area equivalent to the projected area of the dye-cloud. At least 500 dye-clouds are observed and a mean value of diameters obtained from the observation is defined as an average diameter (μm). The minimum color density (also denoted as Dmin) in this invention refers to the lowest color density in the low exposure region in sensitometry of the ISO speed determination. The transmission density of the minimum color density plus 0.1 refers to a density higher by 0.1 than the foregoing Dmin. One feature of this invention is that the average diameter of dye-clouds forming this transmission density in the photographic material is not less than 3.0 μm and not more than 20.0 μm. The average diameter is preferably 6.0 to 20.0 μm. Forming dye-clouds of an average diameter more than 20 μm results in excessively thick layer, leading to serious troubles, such as cracks on the film surface caused in transportation during photographing and processing.

In the color image forming method of this invention, the photographic material is developed, while being heated at a temperature of 43 to 180° C. (and preferably 50 to 160° C.). A temperature of more than 180° C. exceeds the heat-resistance temperature of the photographic material comprising organic material, resulting in troubles, such as melting of the layer and bleeding of an image.

The amount of the dye formed in color development at the site giving a transmission density of the minimum density plus 0.1 is preferably 0.001 to 0.200 mmol/m$^2$. The amount of the formed dye can be determined by various methods. For example, an emulsion layer of the processed photographic material is treated with a proteinase and from the resulting liquid, oil soluble components are extracted with a solvent and after optimally diluting the extracted liquid, the formed dye is quantitatively determined, for example, by means of HPLC (high performance liquid chromatography) using a standard sample which was previously determined with respect to the dye amount. A dye amount of less than 0.001 mmol/m$^2$ requires an expensive specific dye having a high absorption coefficient, while a dye amount of more than 0.200 mmol/m$^2$ results in a lowered dye covering area, in which formed dyes are ineffectively converted into transmission density, producing troubles in contrast design of the high exposure region.

Next, silver halide photographic materials relating to this invention and the color image forming method by the use thereof will be described in detail.

Silver Halide

Silver halides used in this invention may be any halide composition, including silver bromide, silver iodobromide, silver chloride, silver chlorobromide silver iodochlorobromide, and silver iodochloride. In general, silver iodobromide, silver bromide and silver iodochlorobromide are preferably used to achieve high speed and silver chloride and silver chlorobromide are preferably used to perform rapid processing. Silver halide emulsions containing such silver halide grains can be prepared in accordance with methods described in P. Glafkides, Chimie Physique Photographique (published by Paul Montel Corp., 1967); G. F. Duffin, Photographic Emulsion Chemistry (published by Focal Press, 1966); V. L. Zelikman et al., Making and Coating of Photographic Emulsion (published by Focal Press, 1964); JP-A Nos. 51-39027, 55-142329, 58-113928, 54-48521, 58-4938 and 60-138538; and Abstracts of Annual Meeting of Society of Scientific Photography of Japan. Any one of acidic precipitation, neutral precipitation and ammoniacal precipitation is applicable and the reaction mode of aqueous soluble silver salt and halide salt includes single jet addition, double jet addition, a combination thereof, grain formation in the presence of excessive silver ions (reverse precipitation) and supplying a water soluble silver salt and a water soluble halide to fine seed crystals to grow grains.

Grain size distribution of a silver halide emulsion may be narrow or broad, and the emulsion is preferably comprised of monodisperse grains. The monodisperse grains as described herein refer to grains having a width of grain size distribution, i.e., a coefficient of variation of grain size obtained by the formula described below of not more than 25%, and more preferably not more than 20%:

(Standard deviation of grain size/average grain size)×100=Width of grain size distribution (%)

The average grain size of silver halide grains used in this invention is not specifically limited and when the grain volume is represented by equivalent converted to a cube, the edge length is preferably 0.01 to 50 $\mu$m, and more preferably 0.01 to 30 $\mu$m.

The grain form can be of almost any one, including regular form of cubic, octahedral or tetradecahedral grains, and irregular form of twin crystals, such as tabular grains, and the combination thereof. Of these, tabular grains are specifically preferred. The tabular silver halide grains used in this invention are those which have a mean value (mean aspect ratio) of grain diameter/thickness (aspect ratio) of 2 or more, preferably 3 to 20, and more preferably 4 to 15. Outer faces of tabular grains may substantially be comprised of [111] or [100] face. There may be combined [111] and [100] faces. In this invention, the mean aspect ratio is preferably 8 or more. The higher the aspect ratio, silver halide grains are closely packed into the layer, thereby efficiently supplying a color developing agent to the field of reducing reaction. Silver halide grains having a mean aspect ratio of more than 20 have a defect of insufficient stability in the manufacture thereof.

The [111] face preferably accounts for at least 50% (more preferably 60 to 90%, and still more preferably 70 to 95%) of the grain surface of tabular silver iodobromide or silver bromide grains. The ratio accounted for by the Miller index [100] face can be obtained based on T. Tani, J. Imaging Sci., 29, 165 (1985) in which adsorption dependency of a [111] face or a [100] face is utilized.

Tabular silver (iodo)bromide grains used in this invention are preferably hexagonal. The hexagonal tabular grains are referred to as those having hexagonal(111) major faces, of which the maximum adjacent edge ratio is 1.0 to 2.0. The maximum adjacent edge ratio is referred to as a ratio of the maximum edge length of the hexagonal form to the minimum edge length. Corners of the hexagonal tabular grains having a maximum adjacent edge ratio of 1.0 to 2.0 may be rounded, and circular tabular grains are also usable. The edge length of rounded tabular grains is represented by a distance between intersections when a linear edge portion is linearly extended and intersects with extended straight lines of linear portions of adjacent edges. At least ½ of each edge of the hexagonal tabular grains is preferably comprised of a straight line and the maximum adjacent edge length is more preferably 1.0 to 1.5.

The tabular silver (iodo)bromide grains used in this invention preferably contain dislocation lines. The dislocation lines in silver halide grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. The dislocation lines of silver halide grains preferably locate within the region of 0.58 L to 1.0 L, and more preferably 0.80 L to 0.98 L in the direction of from the center of the grain to the outer grain surface. The dislocation lines is directed from the center to the outer surface and often wind. It is preferred that at least 50% by number of silver halide grains contain at least one dislocation line. The higher proportion (by number) of dislocation line-containing tabular grains is also preferred. The tabular grains preferably contain dislocation line(s) in the fringe portion of the grain and more preferably in the fringe portion and within the major faces. The tabular grains preferably contain at least 10 and more preferably at least 20 dislocation lines in the fringe portion. In the invention, the expression "containing dislocation lines in the fringe portion" means that the dislocation lines exist in the vicinity of the circumferential portion, in the vicinity of the edge or in the vicinity of the corner of the tabular grain. Concretely, when the tabular grain is observed vertical to the major face of the grain and a length of a line connecting the center of the major face (i.e., a center of gravity of the major face, which is regarded as a two-dimensional figure) and a corner is represented by "L", the fringe portion refers to the region outside the figure connecting points at a distance of 0.50 L from the center with respect to the respective corners of the grain.

The dislocation lines can be introduced by forming dislocations, as an origin of dislocation lines, at the intended position by commonly known methods, in which, at a desired position of introducing the dislocation lines during the course of forming silver halide grains, an aqueous iodide (e.g., potassium iodide) solution is added, along with an aqueous silver salt (e.g., silver nitrate) solution by a double jet technique, only an iodide solution is added, iodide-containing fine grains are added or an iodide ion releasing agent is employed, as disclosed in JP-A No. 6-11781. Of these are preferred the double jet addition of an aqueous iodide solution and aqueous silver salt solution, addition of fine iodide-containing grains and the use of an iodide ion releasing agent.

The iodide ion releasing agent is a compound capable of releasing iodide ions upon reaction with a base or a nucleophilic agent and represented by the following formula (J):

R—I formula (J)

where R is a univalent organic group. R is preferably an alkyl group, alkenyl group, alkynyl group, aryl group, aralkyl group, heterocyclic group, acyl group, carbamoyl group, alkyloxycarbonyl group, aryloxycarbonyl group, alkylsulfonyl group, arylsulfonyl group, or sulfamoyl group. R is also preferably an organic group having 30 or less carbon atoms, more preferably 20 or less carbon atoms, and still more preferably 10 or less carbon atoms. R may be substituted by at least one substituent. The substituent may be further substituted. Preferred examples of the substituent include a halogen atom, alkyl group, aryl group, aralkyl group, heterocyclic group, acyl group, acyloxy group, carbamoyl group, alkyloxycarbonyl group, aryloxycarbonyl group, alkylsulfonyl group, arylsulfonyl group, or sulfamoyl group, alkoxy group, aryloxy group, amino group, acylamino group, ureido group, urethane group, sulfonylamino group, sulfinyl group, phosphoric acid amido group, alkylthio group, arylthio group, cyano, sulfo group, hydroxy, and nitro.

The iodide ion releasing agents represented by the formula (J) are preferably iodo-alkanes, an iodo-alcohol, iodo-carboxylic acid, iodo-amid, and their derivatives, more preferably iodo-amide, iodo-alcohol and their derivatives, still more preferably iodo-amide substituted by a heterocyclic group, and specifically preferable examples include (iodoacetoamido)-benzenesulfonate.

There can be also employed silver chloride, silver chlorobromide, silver iodochloride and silver iodochlorobromide other than silver bromide and silver iodobromide, in which tabular grains having [100] major faces and tabular grains having [111] major faces are employed. Tabular silver chloride grains having a [100] face are described in U.S. Pat. No. 5,314,798, European Patent Nos. 534,318A and 617, 325A, WO94/22051, European Patent No. 616,255A, U.S. Pat. Nos. 5,356,764, 5,320,938 and 5,275,930, JP-A Nos. 5-204073, 5-281640, 7-225441 and 6-30116. Tabular grains mainly comprised of [111] face are detailed in U.S. Pat. No. 4,439,520. U.S. Pat. No. 5,250,403 discloses so-called ultra-thin tabular grains having an equivalent circle diameter of 0.7 μm or more and a thickness of 0.07 μm. or less; U.S. Pat. No. 4,435,501 discloses a technique of allowing silver salt to epitaxially deposit on the surface of tabular grains.

In tabular grains, the grain size is represented by diameter of a circle having the same area as a projected area of the grain, so-called equivalent circle diameter. The grain projected area can be calculated from the sum of grain areas through electron microscopic observation of silver halide crystal grains placed on a sample board so as not to be overlapped. The average grain diameter of tabular grains, which is represented by a mean value of equivalent circle diameters of the grains is preferably not less than 0.30 μm, more preferably 0.30 to 5 μm, and still more preferably 0.40 to 2 μm. Thus, tabular grains are magnified to 10,000 to 70,000 times by an electron microscope and the printed grain projected area is measured. The average grain diameter ($\phi$) is determined by the following equation:

$$\text{Average grain diameter } (\phi)=(\Sigma n_i \cdot \phi_i)/n$$

where n is the number of measured grains and $n_i$ is a frequency of grains having a diameter of $\phi_i$. In the measurement, at least 1,000 grains are randomly selected.

The thickness of a silver halide grain can be determined by electron microscopic observation of the grain from the oblique direction. The thickness of tabular grains relating to this invention is preferably 0.01 to 1.0 μm, more preferably 0.01 to 0.1 μm, and still more preferably 0.01 to 0.07 μm. Further, the tabular silver halide grains relating to this invention preferably have a narrow thickness distribution. Thus, the width of grain thickness distribution, as defined below is preferably not more than 25%, and more preferably not more than 20%:

$$(\text{standard deviation of thickness/average thickness})\times 100=\text{width of grain thickness distribution } (\%).$$

Taking an aspect ratio and grain thickness into account, the tabularity (A), as defined below is preferably not less than 20:

$$A=ECD/b^2$$

where ECD is an average projected diameter (μm) and b is an average grain thickness. The average projected diameter is a number average of diameters of circles having an area equivalent to the grain projected area.

The tabular silver halide grains relating to this invention preferably have a narrow iodide content distribution. Thus, the halide content distribution among grains, as defined below is preferably not more than 25% and more preferably not more than 20%:

$$\text{Width of halide content distribution}=(\text{standard deviation of halide content/average halide content})\times 100\ (\%)$$

Silver halide grains used in this invention may be a core/shell type structure having at least two layer structures substantially differing in halide composition within the grain or have a homogeneous composition with the grain. The average iodide content of the silver halide emulsion relating to this invention is preferably not more than 20 mol % and more preferably 0.1 to 10 mol %.

In this invention, there may also be used so-called halide conversion type grains. The halide conversion amount is preferably 0.2 to 2.0 mol %, based on silver. The time for conversion may be during or after physical ripening. Halide conversion is performed by addition of an aqueous halide having a solubility product with silver or fine silver halide grains, which is less than that of halide composition on the grain surface prior to conversion. The size of the fine grains is preferably not more than 0.2 μm, and more preferably 0.02 to 0.1 μm.

Silver halide grains may be added with at least one metal ion selected from a cadmium salt, zinc salt, lead salt, thallium salt, iridium salt (including complex salts), rhodium salt (including complex salts) and iron salt (including complex salts) at the stage of nucleation or growth to allow these metal ions to be included in the interior or the surface of the grain.

In the preparation of silver halide emulsions relating to this invention, it is preferred to perform nucleation in the presence of low molecular weight gelatin having a mean molecular weight of 5,000 to 70,000 or gelatin having a methionine content of less than 30 μmol/g. The methionine content at the stage of nucleation is more preferably less than 20 μmol/g and still more preferably 0.1 to 10 μmol/g. The mean molecular weight of the low molecular weight gelatin is more preferably 6,000 to 50,000, and still more preferably 7,000 to 30,000. To reduce the methionine content to less than 30 μmol/g, it is effective to subject alkali-processed gelatin to an oxidation treatment using oxidizing agents. Examples of oxidizing agents usable in the oxidation treatment of gelatin include hydrogen peroxide, ozone, peroxy-acid, halogen, thiosulfonic acid compounds, quinines and organic peracids. Of these is preferred hydrogen peroxide.

Silver halide emulsions relating to this invention may be subjected to desalting to remove soluble salts at the time of completion of grain growth, or may not be desalted. Desalting can be carried out in the manner, as described in Research Disclosure (hereinafter, also denoted simply as RD) No. 17643.

In this invention, at least two emulsion which were separately prepared may be blended at any proportion. Further, there may be used silver halide described in JP-A No. 2002-55410, paragraph No. 0054–0065 and JP-A No. 6-118593, paragraph No. 0060–0078.

Sensitization

Light sensitive silver halide emulsions are those which have been chemically sensitized. Chemical sensitization methods applicable to silver halide emulsions used in this invention include commonly known chalcogen sensitization such as sulfur sensitization, selenium sensitization and tellurium sensitization, novel metal sensitization using gold, platinum or palladium, reduction sensitization or the combination thereof, for example, as described in JP-A Nos. 3-110555 and 5-241267.

There are preferably used sulfur sensitizer and selenium sensitizer as a chalcogen sensitizer applicable to silver halide emulsions relating to this invention. Examples of the sulfur sensitizer include a thiosulfate, allylthiocarbamidothiourea, allylthioisocyanate, cystine, p-toluenethiosulfonate, rhodanine, and inorganic sulfur (simple substance of sulfur). The amount of the added sulfur sensitizer, depending on the kind of an emulsion or expected effects is preferably $5\times10^{-10}$ to $5\times10^{-5}$, and more preferably $5\times10^{-8}$ to $3\times10^{-5}$ mol per mol of silver halide.

There are used, as a gold sensitizer, various gold complexes as well as chloroauric acid and gold sulfide. Ligand compounds include dimethylrhodanine, thiocyanic acid, mercaptotetrazole and mercaptotriazole. The amount of an added gold sensitizer, depending on the kind of an emulsion, the kind of the compound and ripening conditions, is preferably $1\times10^{-8}$ to $1\times10^{-4}$, and more preferably $1\times10^{-8}$ to $1\times10^{-5}$ mol per mol of silver halide.

Chemical sensitization may be carried out in the presence of nitrogen containing heterocyclic compounds, for example, in accordance with the method described in JP-A No. 62-253159. Antifoggants described later may be added when completing chemical sensitization. Specifically, methods described in JP-A Nos. 5-45833 and 62-40446 are applicable thereto. The pH at the stage of chemical sensitization is preferably 5.3 to 10.5, and more preferably 5.5 to 8.5; the pAg is preferably 6.0 to 10.5, and more preferably 6.8 to 9.0.

The coating amount of silver halide used in this invention is within the range of 1 to 10 g/m$^2$ (stated as the equivalent quantity converted to silver).

In the preparation of silver halide relating to this invention, reduction sensitization may be applied in combination with foregoing chemical sensitization. Maintaining a silver halide emulsion in an optimal reducing atmosphere provides reduction sensitization nucleuses in the interior or on the surface of silver halide grains. Reduction sensitization is preferably conducted during the course of growing silver halide grains. A method for conducting the sensitization during the course of grain growth is not only applying reduction with growing grains but also interrupting grain growth and applying reduction sensitization, followed by growing the reduction-sensitized grains. Specifically, a reducing agent and/or water soluble silver salt are added to the silver halide emulsion.

Preferred examples of reducing agents include thiourea dioxide, ascorbic acid and their derivatives. Further thereto, preferred reducing agents include polyamines such as hydrazine and diethylenetriamine, dimethylamine borane, and sulfites. The amount of a reducing agent to be added is variable, depending on the kind of a reducing agent, grain size, composition and crystal habit of silver halide grains and environmental conditions such as temperature, pH and pAg of a reaction system. For example, thiourea dioxide of 0.01 to 2 mg per mol of silver halide is preferred; and ascorbic acid of 0.2 to 50 g per mol of silver halide is preferred. The reduction sensitization is carried out preferably at a temperature of 40 to 80° C., a pH of 5 to 11 and apAg of 1 to 10 over a period of 10 to 200 min. Silver nitrate is preferably used as a water soluble silver salt. So-called silver ripening, as one means for the reduction sensitization is performed by adding the water soluble silver salt. The pAg during the silver ripening is preferably 1 to 6, and more preferably 2 to 4. The temperature, time and pH are within the range described above.

Action of a reducing agent added at an intended time during the course of grain formation can be deactivated by adding oxidizing agents such as hydrogen peroxide or its adducts, peroxo-acid salt, ozone, $I_2$, and thiophene to retard or stop the reduction sensitization. The oxidizing agents can be added at any time of from the start of silver halide grain formation to before adding gold sensitizer (or chemical sensitizer).

In order to allow light sensitive silver halide used in this invention to have spectral sensitivity (or color sensitivity), such as green-sensitivity and red-sensitivity, the light sensitive silver halide emulsion is spectrally sensitized with methine dyes or others. A blue-sensitive emulsion may optionally be subjected to spectral sensitization in the blue region. Usable dyes include, for example, cyanine dyes, merocyanine dyes, complex cyanine dyes, complex merocyanine dyes, holopolar cyanine dyes, hemicyanine dyes, styryl dyes and hemioxonol dyes. Specifically, dyes are exemplarily disclosed in U.S. Pat. No. 4,617,257; JP-A Nos. 59-180550, 64-13546, 5-45828, and 5-45834. These dyes are used alone or in combination thereof. The combination of sensitizing dyes is often used for the purpose of supersensitization or adjustment of the spectral sensitivity wavelength. Dyes themselves not having spectral-sensitizing action or compounds not absorbing visible light and exhibiting supersensitization, so-called supersensitizers may also be contained, together with sensitizing dyes, in the emulsion (e.g., as described in U.S. Pat. No. 3,615,641 and JP-A No. 63-23145). Such supersensitizers may be added during, or before or after chemical ripening, or before or after nucleation of silver halide grains, as described in U.S. Pat. Nos. 4,183,756 and 4,225,666. These sensitizing dyes and supersensitizers may be added through solution in organic solvents such as methanol or in the form of a dispersion in gelatin or a surfactant solution. The amount to be added is within the range of $1\times10^{-8}$ to $1\times10^{-2}$ mol per mol of silver halide.

Additives

Hydrophilic protective colloids used in preparation of silver halide photographic materials relating to this invention include not only gelatin used in conventional silver halide emulsions but also gelatin derivatives such as acetylated gelatin and phthalated gelatin, and synthetic or natural hydrophilic polymers such water-soluble cellulose derivatives.

There are optionally employed various techniques and additives known in the art in silver halide photographic materials relating to this invention. In addition to the light sensitive silver halide emulsion layer, for example, auxiliary layers such as a protective layer, a filter layer, an antihalation layer, a cross-over light-cutting layer and a backing layer are provided, in which a chemical sensitizer, a novel sensitizer, a sensitizing dye, a supersensitizer, a coupler, a high boiling solvent, an antifoggant, a stabilizer, a development inhibitor, a bleach-accelerating agent, anti-staining agent, a formalin scavenger, an image tone modifier, a hardening agent, a surfactant, a thickening agent, a plasticizer, a lubricant, a UV absorber, anti-irradiation dye, a filter light absorbing dye, a fungicide, a polymeric latex, a heavy metal, an antistatic agent, and a matting agent are included. These additives are detailed in RD 176, Item/17643 (December, 1978); ibid 184, Item/18431 (August, 1979), ibid 187, Item/18716 (November, 1979); and ibid 308, Item/308119 (December, 1989).

Specific compounds described in the foregoing RDs are shown below.

| | RD-17643 | | RD-18716 | RD-308119 | |
|---|---|---|---|---|---|
| Additive | Page | Sect. | Page | Page | Sect. |
| Chemical Sensitizer | 23 | III | 648 Upper right | 996 | III |
| Sensitizing Dye | 23 | IV | 648–649 | 996–998 | IV |
| Desensitizing Dye | 23 | IV | — | 998 | IV |
| Dye | 25–26 | VIII | 649–650 | 1003 | VIII |
| Development Accelerator | 29 | XXI | 648 Upper right | — | — |
| Antifoggant Stabilizer | 24 | IV | 648 Upper right | 1006–1007 | VI |
| Brightener | 24 | V | — | 998 | V |
| Hardener | 26 | X | 651 Left | 1004–1005 | X |
| Surfactant | 26–27 | XI | 650 Right | 1005–1006 | XI |
| Antistatic agent | 27 | XII | 650 Right | 1006–1007 | XIII |
| Plasticizer | 27 | XII | 650 Right | 1006 | XII |
| Lubricant | 27 | XII | — | — | — |
| Matting Agent | 28 | XVI | 650 Right | 1008–1009 | XVI |
| Binder | 26 | XXII | — | 1003–1004 | IX |
| Support | 28 | XVII | — | 1009 | XVII |

Color Developing Agent

In this invention, there may be used a color developing agent, which is oxidized to form an oxidation product upon reduction of silver halide or organic silver salt and capable of forming a dye on coupling with a coupler, or a precursor of a color developing agent (also called a color developing agent precursor or blocked color developing agent), which is capable of forming a color developing agent when subjected to heat, alkali or a nucleophilic agent.

Examples of the color developing agent and color developing agent precursor include compounds (C-1) through (C-16) described in JP-A No. 4-86741, page 7–9; and water-soluble color developing agents and their hydrochloride, sulfate or p-toluenesulfonate of (1) through (26) described in JP-A No. 3-246543, page 6–10. Other Examples include a sulfonamidophenol type developing agent described in JP-A No. 9-15806; hydrazine type developing agents described in JP-A Nos. 5-241282, 8-234388, 8-286340, 9-152700, 9-152701, 9-152702, 9-152803 and 9-152704; hydrazone type developing agents described in JP-A Nos. 7-202002 and 8-234390; and a developing agent described in JP-A No. 2002-55418, paragraph 0103 to 0108.

In this invention, the use of the color developing agent precursor is preferred to enhance storage stability of a color developing agent. Examples thereof include indoaniline type compounds described in U.S. Pat. No. 3,342,597; Schiff base type compounds described in U.S. Pat. No. 3,342,599, RD No. 14,850 and ibid No. 15,159; aldol compounds described in RD NO. 13,924; metal complex salts described in U.S. Pat.3,719,492; and urethane type compounds described in JP-A No. 53-135628. Further are also preferred color developing agent precursors releasing p-phenylenediamines, represented by formulas (1) through (6) described in U.S. Pat. No. 6,455,235 or JP-A No. 2002-55418:

formula (1)

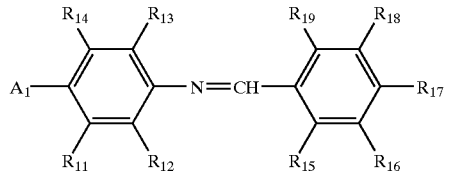

wherein $R_{11}$ through $R_{19}$ each represent a hydrogen atom or a substituent, provided that $R_{11}$ and $R_{12}$, $R_{13}$ and $R_{14}$, $R_{15}$ and $R_{16}$, $R_{16}$ and $R_{17}$, $R_{17}$ and $R_{18}$, or $R_{18}$ and $R_{19}$ may combine with each other to form a ring; and $A_1$ represents a hydroxy group or a substituted amino group, provided that the substituted amino group of $A_1$ may combine with $R_{11}$ or $R_{14}$ to form a ring;

formula (2)

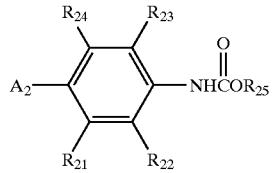

wherein $R_{21}$ through $R_{25}$ each represent a hydrogen atom or a substituent, provided that $R_{21}$ and $R_{22}$, or $R_{23}$ and $R_{24}$ may combine with each other to form a ring; and $A_2$ represents a hydroxy group or a substituted amino group, provided that the substituted amino group of $A_2$ may combine with $R_{21}$ or $R_{24}$ to form a ring;

formula (3)

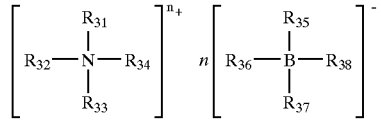

wherein $R_{31}$ through $R_{38}$ each represent a hydrogen atom or a substituent and n is an integer of 1 to 5;

formula (4)

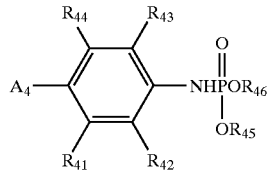

wherein $R_{41}$ through $R_{44}$ each represent a hydrogen atom or a substituent, provided that $R_{41}$ and $R_{42}$, or $R_{43}$ and $R_{44}$ may combine with each other to form a ring; $A_4$ represents a hydroxy group or a substituted amino group, provided that the substituted amino group of $A_4$ may combine with $R_{41}$ or $R_{44}$ to form a ring; and $R_{45}$ and $R_{46}$ each represent an alkyl group having 1 to 12 carbon atoms or an aryl group;

formula (5)

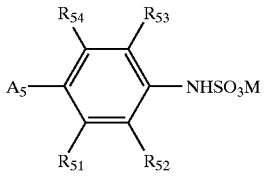

wherein $R_{51}$ through $R_{54}$ each represent a hydrogen atom or a substituent, provided that $R_{51}$ and $R_{52}$, or $R_{53}$ and $R_{54}$ may combine with each other to form a ring; $A_5$ represents a hydroxy group or a substituted amino group, provided that the substituted amino group of $A_5$ may combine with $R_{51}$ or $R_{54}$ to form a ring; and M represents a hydrogen atom, an alkali metal, ammonium, a nitrogen-containing organic base or a quaternary nitrogen-containing compound;

formula (6)

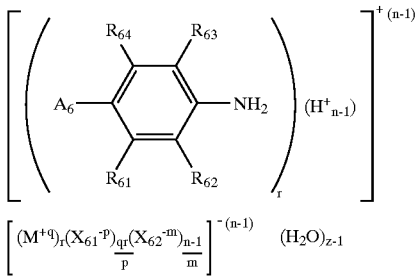

wherein $R_{61}$ through $R_{64}$ each represent a hydrogen atom or a substituent, provided that $R_{61}$ and $R_{62}$, or $R_{63}$ and $R_{64}$ may combine with each other to form a ring; $A_6$ represents a hydroxy group or a substituted amino group, provided that the substituted amino group of $A_6$ may combine with $R_{61}$ or $R_{64}$ to form a ring; $M^{+q}$ is a metal ion; q is an integer of 2 or 3; r is an integer of 1 or 2; $X_{61}^-$ and $X_{62}^-$ each represents an anion; p is an integer of 1 or 2; m is an integer of 1 or 2; n is an integer of 1 through 3; and z is an integer of 1 through 5.

Specifically, compounds represented by formula (2) exhibit superior storage stability and color developability. There are also usable compounds described in WO 01/96,954. WO 01/96,954, European Patent Nos. 1,164,417, 1,164,4181,158,358, 1,158,359, 1,160,612, 1,113,316 and 1,113,325; U.S. Pat. Nos. 6,319,640, 6,306,551, 6,312,879, 2001/12886; JP-B No. 8-3614 and 8-3616 (hereinafter, the term, JP-B is referred to as Japanese Patent Publication).

Examples of the color developing agent and a coupler include the combination of p-phenylenediamine type developing agents and phenol or active methylene couplers described in U.S. Pat. No. 3,531,256 and the combination of p-aminophenol developing agents and active methylene couplers described in U.S. Pat. No. 3,761,270. The combination sulfoneamidophenols and four-equivalent couplers exhibited superior raw stock stability when included in photographic material, as described in U.S. Pat. No. 4,021,240 and JP-A No. 60-128438.

These color developing agents and precursor thereof may be included in photographic material or a processing element (processing sheet or also called a photographic useful compound-providing medium), or contained in solution to be provided onto photographic material. b In this invention, allowing the color developing agent or a precursor thereof to be included photographic material is more preferred. Inclusion in the photographic material enable to design a system superior in environment suitability and rapid accessibility. In cases where included in photographic material, relatively high stability can be achieved even after storage. In this case, it is preferred to use a compound which does not unnecessarily reduce silver salts.

In cases where incorporated in a photographic material or a processing element, a color developing agent or a precursor thereof is preferably incorporated in an amount of 0.05 to 10 mmol, more preferably 0.1 to 5 mmol, and still more preferably 0.2 to 2.5 mmol per $m^2$ of the light-sensitive layer.

Image Tone Modifier

The photographic material relating to this invention preferably contains an image tone modifier. Specifically, allowing an image tone modifier to be concurrently present with organic silver salts or reducing agents is preferred, thereby enhancing effective transport of silver ions. Preferred image tone modifiers used in this invention are described in RD 17029, and specific examples include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides [for example, N-(dimethylaminomethyl)phthalimide]; blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H, 4H-2,3a,5,6a-tatraazapentalene). Preferred image color control agents include phthalazone or phthalazine, which is preferably used in combination with phthalic acids. The content is preferably 0.05 to 0.5 g, and more preferably 0.1 to 0.3 g per $m^2$ of the light-sensitive layer.

Coupler

Next, explanation will be given of couplers. The coupler used in this invention is referred to as a compound capable of forming a dye upon reaction with an oxidation product of the color developing agent described above. Preferred couplers used in this invention include compounds having structures represented by the following formulas (Cp-1) through (Cp-12), as described in JP-A No. 2001-154325. These are generally called active methylene, pyrazolone, pyrazoloazole, phenol and naphthol.

Cp-1

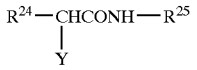

Cp-2

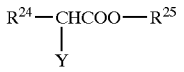

Cp-3

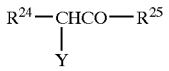

Cp-4

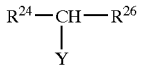

Cp-5

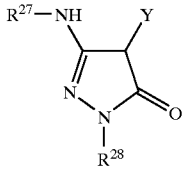

Cp-6

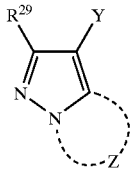

Cp-9

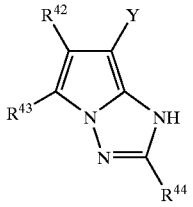

Cp-10

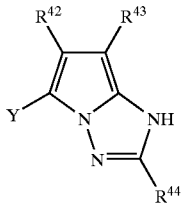

Cp-11

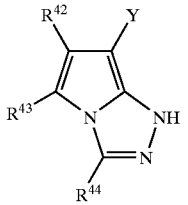

-continued

Cp-12

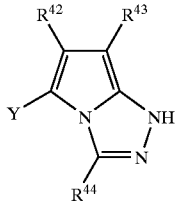

The couplers represented by formulas (Cp-1) through (Cp-4) are called an active methylene type coupler. In the formula (Cp-1) through (Cp-4), $R_{24}$ represents an acyl group, cyano group, nitro group, aryl group, heterocyclic group, alkoxycarbonyl group, aryloxycarbonyl group, carbamoyl group, sulfamoyl group, alkylsulfonyl group, and arylsulfonyl group, each of which may be substituted; $R_{25}$ represents an alkyl group, $R_{25}$ represents an alkyl group, aryl group or heterocyclic group, each of which may be substituted. In the formula (Cp-4), $R_{26}$ represents an aryl group or heterocyclic group, which may be substituted. Examples of substituent for $R_{24}$, $R_{25}$ and $R_{26}$ include an alkyl group, cycloalkyl group, alkenyl group, alkynyl group, aryl group, heterocyclic group, alkoxy group, aryloxy group, cyano group, halogen atom, acylamino group, sulfonamido group, carbamoyl group, sulfamoyl group, alkoxycarbonyl group, aryloxycarbonyl group, alkylamino group, arylamino group, hydroxy group, sulfo group, etc. $R_{24}$ is preferably an acyl group, cyano group, carbamoyl group, or alkoxycarbonyl group.

In the formulas (Cp-1) through (Cp-4), Y represents a hydrogen atom or a group capable of leaving upon coupling reaction with an oxidation product of a color developing agent. Examples of a group acting as an anionic coupling-off group of a two-equivalent coupler include a halogen atom (e.g., chlorine, bromine), alkoxy group (e.g., methoxy, ethoxy), aryloxy group (e.g., phenoxy, 4-cyanophenoxy, 4-alkoxycarbonylphenyl), alkylthio group (e.g., methylthio, ethylthio, butylthio), arylthio group (e.g., phenylthio, tolylthio), alkylcarbamoyl group (e.g., methylcarbamoyl, dimethylcarbamoyl, ethylcarbamoyl, dibutylcarbamoyl, dimethylcarbamoyl, dimethylcarbamoyl, piperidylcarbamoyl, morpholylcarbamoyl), arylcarbamoyl group (e.g., phenylcarbamoyl, methylphenylcarbamoyl, ethylphenylcarbamoyl, benzylphenylcarbamoyl), alkylsulfamoyl (e.g., methylsulfamoyl, dimethylsulfamoyl, ethylsulfamoyl, diethylsulfamoyl, dibutylsulfamoyl, piperidylsulfamoyl, morpholylsulfamoyl), arylsulfamoyl group (e.g., phenylsulfamoyl, methylphenylsulfamoyl, ethylphenylsulfamoyl, benzylphenylsulfamoyl), cyano group, alkylsulfonyl group (e.g., methanesulfonyl, ethanesulfonyl), arylsulfonyl group (e.g., phenylsulfinyl, 4-chlorophenylsulfonylp-toluenesulfonyl), alkylcarbonyloxy group (e.g., acetyloxy, propionyoxy, butyloyloxy), arylcarbonyloxy group (e.g., benzoyl, toluyloxy, anicyloxy), and nitrogen containing heterocyclic group (e.g., imidazolyl, benzotriazolyl).

Examples of the group acting as an anionic coupling-off group of a four-equivalent coupler include a hydrogen atom, formyl group, carbamoyl group, substituted methylene group (e.g., substituent; aryl, sulfamoyl, carbamoyl, alkoxy, imino and hydroxy group), acyl group, and sulfonyl group. In formulas (Cp-1) through)Cp-4), $R_{24}$ and $R_{25}$, or $R_{24}$ and $R_{26}$ may combine with each other to form a ring.

The formula (Cp-5) represents a so-called 5-pyrazoloe type magenta coupler, wherein $R_{27}$ represents an alkyl group, aryl group, acyl group, or carbamoyl group; $R_{28}$ represents a phenyl group at least one halogen atom, alkyl group, cyano group, alkoxy group, alkoxycarbonyl group, or acylamino group; Y is the same as defined in the formulas (Cp-1) through (Cp-4).

Of the 5-pyrazoloe type magenta couplers represented by formula (Cp-5) is preferred one having $R_{27}$ of an aryl group or acyl group and $R_{28}$ of a phenyl group substituted by at least one halogen atom. Thus, $R_{27}$ is an aryl group such as phenyl, 2-chlorophenyl, 2-methoxyphenyl, 2-chloro-5-tetradecaneamidophenyl, 2-chloro-5-octadecylsulfoneamidophenyl, and 2-chloro-5-[2-(4-hydroxy-3-t-butylphenoxy)tetradecaneamido]phenyl, or an acyl groyp such as acetyl, pivaloyl, tetradecanoyl, 2-[2,4-di-t-pentylphenoxy]acetyl, 2-(2,4-di-t-pentylphenoxy) butanoyl, benzoyl and 3-(2,4-di-t-amylphenoxyacetoamido) benzoyl. These groups may be substituted. Examples of a substituent include organic substituent groups containing a carbon atom, oxygen atom. nitrogen atom or sulfur atom, and a halogen atom. $R_{28}$ is preferably a substituted phenyl group such as 2,4,6-trichlorophenyl, 2,5-dichlorophenyl or 2-chlorophenyl.

The formula (Cp-6) represents a pyrazoloazole type coupler, wherein $R_{29}$ represents a hydrogen atom or a substituent group; Z represents an atomic group necessary to form a 2 to 4 nitrogen atom-containing azole ring, which may be substituted by a substituent (including a condensed ring); Y is the same as defined in the foregoing formulas (Cp-1) through (Cp-4).

Of pyrazoloazole type couplers represented by formula (Cp-6), imodizo[1,2-b]pyrazoles desribed in U.S. Pat. No. 4,500,630, pyrazolo[1,5-b]-1,2,4-triazoles described in U.S. Pat. No. 4,540,654, and pyrazolo[5,1-c]-1,2,4-triazoles described in U.S. Pat. No. 3,725,067 are preferred in terms of absorption characteristics of the formed dye; and pyrazolo [,15-b]-1,2,4-triazoles are preferred in terms of lightfastness. Substituent groups for substituent group $R_{29}$ and the azole ring represented by Y or Z are detailed, for example, in U.S. Pat. No. 4,540,654, col. 2 line 41 to col. 8, line 27. Specifically, a pyrazoloazole coupler in which a branched alkyl group is directly attached to the 2-, 3 or 6 position of the pyrazoloazole group, as described in JP-A 61-65245; a pyrazoloazole coupler containing a sulfoneamido group in the molecule, described in JP-A 61-65245;a pyrazoloazole coupler containing an alkoxyphenylsulfoneamido ballast group, described in JP-A 61-147254; a pyrazoloazole coupler containing an alkoxy or aryloxy group at the 6-position, described in JP-A Nos. 62-209457 and 63-307453; and a pyrazoloazole coupler a carbonamido group in the molecule, described in JPA No. 2-201443 are preferred.

Compounds represented by formulas (Cp-7) and (Cp-8) are called a phenol type coupler and naphthol type coupler. In the formulas (Cp-7) and (Cp-8), $R_{30}$ represents $=NHCOR_{32}$, $—SO_2NR_{32}R_{33}$, $—NHSO_2R_{32}$, $—NHCOR_{32}$, $—NHCONR_{32}R_{33}$, $—NHSO_2NR_{32}R_{33}$, which $R_{32}$ and $R_{33}$ are each a hydrogen atom or a substituent; $R_{31}$ represents a substituent; 1 is an integer of 0 to 2 and m is an integer of 0 to 4; Y is the same as defined in formulas (Cp-1) through (Cp-4); and $R_{31}$ to $R_{33}$ are the same substituent as defined in $R_{24}$ to $R_{26}$.

Preferred examples of the phenol type coupler represented by formula (Cp-7) include 2-alkylamino-5-alkylphenol type couplers described in U.S. Pat. Nos. 2,369,929, 2,801,171, 2,772,162, 2,895,826, 3,772,002; 2,5-diacylaminophenol type couplers described in U.S. Pat. Nos. 2,772,162, 3,758, 308, 4,126,396, 4,334,011, 4,327,173, West German Patent No. 3,329,729, JP-A No. 59-166956; and 2-phenylureido-5-acylaminophenol described in U.S. Pat. Nos. 3,446,622, 4,333,999, 4,451,559 and 4,427,767. Preferred examples of the naphthol type coupler represented by formula (Cp-8) include 2-carbamoyl-1-naphthol described in U.S. Pat. Nos. 2,474,293, 4,052,212, 4,146,396, 4,228,233 and 4,296,200; and 2-carbamoyl-5-amido-1-naphthol described in U.S. Pat. No. 4,690,200.

Compounds represented by formulas (Cp-9) through (Cp-12) are called pyrrolotriazole couplers. In the formulas, $R_{42}$, $R_{43}$ and $R_{44}$ represent a hydrogen atom or a substituent; Y is the same as defined in formulas (Cp-1) through (Cp-4). The substituent represented by $R_{42}$, $R_{43}$ and $R_{44}$ is the same as defined in the foregoing $R_{24}$ through $R_{26}$. Preferred examples of the pyrrolotriazole type couplers represented by formulas (Cp-9) through (Cp-12) include those described in European Patent Nos. 488,248A1, 491,197A1 and 545,300, in which at least one of $R_{42}$ and $R_{43}$ is an electron-withdrawing group.

There are also employed condensed cyclic phenol type couplers, imidazole type couplers, pyrrole type couplers, 3-hydroxypyridine type couplers, active methylene type couplers, 5,5-condensed heterocyclic coupler and 5,6-condensed heterocyclic couplers. Examples of the condensed phenol type coupler include those described in U.S. Pat. Nos. 4,327,173, 4,564,586 and 4,904,575; examples of the imidazole type couplers include those described in U.S. Pat. Nos. 4,818,672 and 5,051,347; examples of the pyrrole type couplers include those described in JP-A Nos. 4-188137 and 4-190347; examples of the 3-hydroxypyridine type couplers include those described in JP-A No. 1-315736; examples of the active methylene type couplers include those described in U.S. Pat. Nos. 5,104,783 and 5,162,196; examples of the 5,5-condensed heterocyclic couplers include pyrrolopyrazole type couplers described din U.S. Pat. No. 5,164,289 and pyrroloimidazole type couplers described in JP-A No. 4-174429; examples of the 5,6-condensed heterocyclic couplers include pyrazolopyrimidine type coupler described in U.S. Pat. No. 4,950,585 and pyrrolotriazine type couplers described in JP-A 4-204730.

In addition to the foregoing couplers, there are also usable couplers described in West German Patent Nos. 3,819,051A and 3,823,049; U.S. Pat. Nos. 4,840,883, 5,024,930, 5,051, 347, 4,481,268; European Patent Nos. 304,856A2, 329,036, 354,549A2, 374,781A2, 379,110A2, 386,930A1; JP-A 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-1948474-204532, 4-204731 and 4-204732.

Compounds generally known as a yellow coupler, magenta coupler and cyan coupler are usable in the silver halide photographic material relating to this invention. These compounds are used for color photography, which exhibit a spectral absorption maximum in the blue region (wavelengths of 350 to 500 nm), the green region (wavelengths of 500 to 600 nm) and the red region (wavelengths of 600 to 750 nm), respectively, upon reaction with an oxidation product of a color developing agent. In cases where using hydrazine type or sulfonamide type developing agents, dyes formed on coupling exhibit an absorption maximum different in wavelength from the foregoing. It is therefore necessary to select the kind of couplers in accordance with the kind of a developing agent used. The photographic material relating to this invention is not necessarily designed to have spectral absorption maximums in the blue, green and red regions. The formed dye may have spectral absorption in the UV or infrared region, which may be combined with absorption in the visible region.

Couplers used in this invention may have a polymeric ballast group. There may be usable any one of a four-equivalent coupler and a two-equivalent coupler, and it is preferable to use them properly. For example, it is preferred to use four-equivalent couplers for developing agents represented by formulas (1) through (3) described in JP-A No. 2001-5155, and it is also preferred to use two-equivalent couplers for developing agents represented by formulas (4) and (5) described in JP-A No. 2001-5155. Specific examples including four- and two-equivalent couplers are described in literature or patents, such as "The Theory of the Photographic Process" (4th Ed., T. H. James, Macmillan, 1977) page 291–334 and 354–361; JP-A Nos. 58-12353, 58-149046, 58-149047, 59-11114, 59-124399, 59-174835, 59-231539, 59-231540, 60-2951, 60-14242, 60-23474, 60-66249, 8-1106088-146552, 8-146578 and 9-204031.

The photographic material relating to this invention may contains the following functional couplers. Couplers to correct unwanted absorption of a dye include yellow-colored cyan couplers described in European Patent No. 456,257A1, yellow0 colored magenta couplers described the foregoing patent, magenta-colored cyan couplers described in U.S. Pat. No. 4,833,069, colorless masking couplers represented by formula (A) described in WO 92/11575 (specifically, exemplified compounds on pages 36–45). Compounds (including couplers) capable of forming a photographically useful compound moiety upon reaction with an oxidation product of a color developing agent include, for example, development inhibitor releasing compounds such as compounds represented by formulas (I) through (IV) described in European Patent No. 378,236A1, page 11, compounds represented by formula (I) described in European Patent No. 436,938A2, page 7, compounds represented by formula (1) described in JP-A No. 5-307248, compounds represented by formulas (I), (II), and (III) described in European Patent No. 440,195A2, page 5–6 and compounds represented by formula (I) described in JP-A No. 6-59411; a ligand-releasing compound such as compounds represented by LIG-X described in claim 1 of U.S. Pat. No. 4,555,478.

The foregoing couplers used in this invention may be used alone or in combination thereof, or in combination other couplers. It is preferred that the coupler be included in the same layer as a developing agent and a silver halide emulsion, or the same layer as a silver halide emulsion. In cases where included in the same layer as a developing agent and a silver halide emulsion, the amount of the coupler is preferably 0.05 to 20 mol, more preferably 0.1 to 10 mol, and still more preferably 0.2 to 5 mol per mol of a developing agent. The coupler is included preferably in amount of 0.01 to 1 mol, and more preferably 0.02 to 0.6 mol per mol of silver halide.

Hydrophobic additives such as couplers and color developing agents can be incorporated into a predetermined layer of the photographic material according to methods described in U.S. Pat. No. 2,322,027. In this case, high boiling solvents described in U.S. Pat. Nos. 4,555,470, 4,536,466, 4,536,467, 4,587,206, 4555,476 and 4,599,297; and JP-B No. 3-62,256 can be used, optionally in combination with low boiling solvents having a boiling point of 50 to 160° C. These couplers and high boiling solvents may respectively used in combination thereof. The amount of the high boiling solvent is preferably not more than 10 g, more preferably not more than 5 g, and still more preferably 1 to 0.1 g per g of hydrophobic additive. The high boiling solvent is also preferably not more than 1 ml, more preferably not more than 0.5 ml, and still more preferably not more than 0.3 ml per g of binder. There is also applicable a dispersing method using polymers, as described in JP-B No. 51-39,853 and JP-A No. 51-59943.

In this invention, the silver halide photographic material preferably contains a Fischer dispersion type coupler. For example, methods described in JP-A No. 59-60437 and JP-B No. 6-64319 may be applied to disperse the Fischer type coupler in an alkaline aqueous solution. In this case, the coupler, which contains an acid group such as a carboxylic acid or sulfonic acid is introduced into a hydrophilic colloid in the form of an alkaline aqueous solution. There is also applicable incorporation in the form of a fine solid particular dispersion, as described in JP-A No. 62-30,242.

In the case of a coupler being substantially water-insoluble, the coupler can be incorporated in the form of fine particles dispersed in a binder. Various surfactants can be employed to disperse hydrophobic compounds in hydrophilic colloid, for example, as described in JP-A 59-157636, page 37–38, Table 1. There are also usable phosphoric acid ester type surfactants described in JP-A Nos. 7-66267 and 7-228589 and West German Patent No. 1,932,299A.

Hydrazine Derivative

The silver halide color photographic material relating to this invention preferably contains hydrazine derivatives and preferred hydrazine derivatives are represented by the following formula [H]:

formula [H]

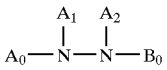

wherein $A_0$ is an aliphatic group, aromatic group, heterocyclic group, each of which may be substituted, or —$G_0$—$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=$NG_1D_1$)—, —SO—, —$SO_2$— or —P(O)($G_1D_1$)— group, in which $G_1$ is a bond, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is a hydrogen atom, an aliphatic group, aromatic group, heterocyclic group, amino group, alkoxy group, aryloxy group, alkylthio group or arylthio group. $D_0$ is preferably a hydrogen atom, an alkyl group, an alkoxy group or an amino group.

In formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfo-oxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ is preferably a monocyclic or condensed-polycyclic one containing at least one heteroatom selected from nitrogen, sulfur and oxygen, including residues of a pyrrolidine ring, imidazole ring, tetrahydrofuran ring, morpholine-ring, pyridine ring, pyrimidine ring, quinoline ring, thiazole-ring, benzthiazole ring, thiophene ring or furan ring. In —$G_0$—$D_0$ group represented by $A_0$, $G_0$ is a —CO—, —COCO—, —CS—, —C(=$NG_1D_1$)—, —SO—, —$SO_2$— or —P(O)($G_1D_1$)— group, and preferred $G_0$ is a —CO—, —COCOA—, in which $G_1$ is a linkage, or —O—, —S— or —N($D_1$)—, in which $D_1$ represents a hydrogen atom, or an aliphatic group, aromatic group or heterocyclic group, provided that when a plural number of $D_1$ are present, they may be the same with or different from each other. $D_0$ is a hydrogen atom, an aliphatic group, aromatic group, heterocyclic group, amino group, alkoxy group, aryloxy group, alkylthio group, or arylthio group, and $D_0$ is preferably a hydrogen atom, alkyl group, alkoxy group or amino group. The aromatic group, heterocyclic group and —$G_0$—$D_0$ group may be substituted.

Specifically preferred $A_0$ is an aryl group or —$G_0$—$D_0$ group.

$A_0$ contains preferably a non-diffusible group or a group for promoting adsorption to silver halide. A ballast group used in immobile photographic additives such as a coupler, as the non-diffusible group is preferable. The ballast group includes an alkyl group, alkenyl group, alkynyl group, alkoxy group, phenyl group, phenoxy group and alkylphenoxy group, each of which has 8 or more carbon atoms and is photographically inert. The group for promoting adsorption to silver halide include, for example, thiourea group, thiourethane group, mercapto group, thioether group, thione group, heterocyclic group, thioamido-heterocyclic group, mercapto-heterocyclic group, and adsorption-promoting group described in JP-A No. 64-90439.

In Formula (H), $B_0$ is a blocking group, and preferably —$G_0$—$D_0$, wherein $G_0$ is a —CO—, —COCO—, —CS—, —C(=N$G_1D_1$)—, —SO—, —$SO_2$— or —P(O)($G_1D_1$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxy or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxaly).

Specific examples of the compound represented by formula [H] include compounds H-1 through H-30 described in paragraph 0046 through 0051 of JP-A No. 2002-55410, but are by no means limited to these. Other preferred hydrazine derivatives include, for example, compounds H-1 through H-29 described in U.S. Pat. No. 5,545,505 col. 11 to col. 20; and compounds 1 through 12 described in U.S. Pat. No. 5,464,738, col. 9 9–11.

These hydrazine derivatives can be readily synthesized in accordance with commonly known methods. The hydrazine derivatives are incorporated into a light-sensitive layer containing a silver halide emulsion or a layer adjacent thereto. An incorporating amount, depending on grain size and halide composition of silver halide grains, an extent of chemical sensitization and the kind of antifoggant, is preferably $1\times10^{-6}$ to $1\times10^{-1}$ mol, and more preferably $1\times10^{-5}$ to $1\times10^{-2}$ mol per mol of silver halide.

Organic Silver Salt

The silver halide color photographic material relating to this invention preferably contains commonly known organic silver salts to enhance sensitivity or developability.

Organic silver salts usable in this invention include silver salts of long chain fatty acids and heterocycle-containing carboxylic acids, e.g., silver behenate, α-(1-phenyltetrazolethio)acetate, as described in JP-A Nos. 53-49241, 49-52626, 52-141222, 53-36224, 53-37626, 53-36224 and 53-37610; and silver salts of imino group containing compounds, as described in JP-B Nos. 44-26582, 45-12700, 45-18416 and 45-22815; JP-A Nos. 52-137321, 58-118638, and 58-118639; U.S. Pat. No. 4,123,274. There are also usable acetylene silver salts described in JP-A No. 61-249044 and complex salts of mercapto-containing compound and silver described in WO 01/96950. Of these are preferred silver salts of benzotriazole and its derivatives) e.g., benzotriazole silver salt, 5-methylbenzotriazole silver salt), silver behenate and silver complex of 1-phenyl-5-mercapto-tetrazole.

The foregoing organic silver salts may be used alone or in combination, which are prepared in an aqueous hydrophilic colloid solution such as an aqueous gelatin solution and desalted to be use as it is. Alternatively, the formed organic salt is separated and mechanically ground to fine particles and dispersed.

The organic silver salt is used in an amount of 0.01 to 10 mol, and preferably 0.05 to 3 mol in combination with 1 mol of light-sensitive silver halide. The total amount of the light-sensitive silver salt and organic silver salt, represented by equivalent converted to silver is 0.05 to 30 g/$m^2$, and preferably 0.1 15 g/$m^2$. The silver halide color photographic material relating to this invention preferably contains organic silver salt grains having a mono-dispersibility of not less than 0.1% and less than 25%. The grain size of an organic silver salt refers to an edge length when the organic silver salt grains are regular crystals such as cubic or octahedral grains. In the case of being not regular crystals, the grain size is expressed in a diameter of a sphere having a volume equivalent to that of the grain, i.e., equivalent sphere diameter. The monodispersibility (or coefficient of variation of grain size) is defined as follows:

Monodispersibility (%)=(standard deviation of grain size)/(mean grain size)×100

Preparation of organic silver salt grains having a monodispersibility of less than 0.1% needs a large amount of manpower and is not realistic. On the contrary, An organic silver salt grains having a monodispersibility of more than 25% results in unfavorable uneven images.

Antifoggant

Antifoggants usable in this invention include, fir example, higher fatty acids describe din U.S. Pat. No. 3,645,739; mercuric salts described in JP-B No. 47-11113; N-halogen compounds described in JP-A NO. 51-47419; mercapto-releasing compounds described in U.S. Pat. No. 3,700,457, JP-A Nos. 51-50725, 2-297548 and 2-282241; arylsulfonic acids described in JP-A No. 49-125016; lithium carbonate described in JP-A No. 51-47419; oxidizing agents described in British patent No. 1,455,271 and JP-A No. 50-101019; sulfonic acids and thiosulfonic acids described in JP-A No. 53-19825; Thiouracils described in JP-A No. 51-3223; sulfur described in JP-A 51-26019; disulfides, and polysulfides described in JP-A Nos. 51-42529, 51-81124 and 55-93149; rosin and di-terpene described in JP-A No. 51-57435; Polymeric acids containing a carboxy group or sulfonic acid group, described in JP-A No. 51-104338; thiazolithione described in U.S. Pat. No. 4,138,265; triazoles described in JP-A Nos. 54-51821 and 55-142331 and U.S. Pat. No. 4,137,079; thiosulfinic acid esters described in JP-A No. 55-140883; di- or tri-halides describe din JP-A Nos. 59-46641, 59-57233 and 59-57234; thiol compounds described in JP-A No. 59-111636; and hydroquinone derivatives described in JP-A Nos. 60-198540 and 60-227255. Other preferred antifoggants include hydrophilic group containing antifoggant described in JP-A No. 62-78554; polymeric antifoggants described in JP-A No. 62-121452; and ballast group containing antifoggants described in JP-A No. 62-123456. There is also preferred non-dye-forming couplers described in JP-A No. 1-161239. Furthermore, antifoggants such as organic silver salts described above and compounds described in JP-A In this invention are usable various antifoggants and stabilizers, and their precursors. Specific examples thereof include compounds described in the foregoing Research Disclosure, compounds described in U.S. Pat. Nos. 5,089,378, 4,500,627 and 4,614,702, JP-A Nos. 64-13564, page 7-9,57-71 and 81-97, and compounds described in U.S. Pat. Nos. 4,775,610, 4,626,500, and 4,983,494; JP-A Nos. 62-174747, 62-239148, 1-150135, 2-1105572-1789148, RD 17,643 (1978) page 24–25, European Patent Nos. 1,164,419 and 1,164,421, JP-A Nos. 2002-23326, and 2002-31878.

These compounds is used preferably in an amount of $5\times10^{-6}$ to 10 mol, and more preferably $1\times10^{-6}$ to 5 mol per mol of silver.

Layer Arrangement

In the photographic material relating to this invention, various layers such as a protective layer, subbing layer, interlayer, yellow filter layer, and antihalation layer can be provided on or below the light-sensitive layer. There may be provided a backing layer on the opposite side of a support. Specifically, there can be provided a sublayer described in U.S. Pat. No. 5,051,335, an interlayer containing solid pigment, interlayer containing a reducing agent or DIR compound described in JP-A Nos. 1-120553, 5-34884 and 2-64634, interlayer containing a electron transfer agent described in U.S. Pat. Nos. 5,017,454 and 5,139,919, JP-A No. 2-235044, a protective layer containing a reducing agent described JP-A No. 4-249245, and combinations of the foregoing layers.

Various layer arrangements are applicable to the silver halide color photographic material relating to this invention, including a conventional layer order, reverse layer order and unit layer arrangement.

Dyestuff

In the silver halide color photographic material, dyes having different absorption in various wavelength regions are used for antihalation or anti-irradiation. Since fine colloidal silver particles are used in the yellow filter layer or antihalation layer of conventional silver halide color photographic materials, the bleaching process is needed to remove the colloidal silver after completion of development. Photographic material having no necessity for bleaching is desirable for the purpose of enhancing simplicity of the process. Accordingly, it is preferred to replace the colloidal silver by using dyes, specifically ones that are capable of being decolorized, leached out or transferred during process and having little contribution to density after completion of the processing. The dye capable of being decolorized or removed during process means that the content of the dye remaining after completion of the processing is not more than ⅓, and preferably not more than 1/10 of the dye contained in the photographic material before being processed. Dye component(s) may be leached out of the photographic material during process, transferred to a processing element, or changed to a colorless compound upon reaction during process.

These dyes may be incorporated into a silver halide emulsion layer or a light-insensitive layer. To allow sensitivity and sharpness to be compatible with each other, it is preferred for a silver halide emulsion sensitive to a specific wavelength region to incorporate a dye having absorption in the same wavelength region as the silver halide emulsion into the position opposite to a light source. Dyes usable in the photographic material relating to this invention include commonly known dyes, such as a dye soluble in an alkali in a developer solution or a dye capable of being decolorized upon reaction with ingredients of the developer solution, such as a sulfite ion, developing agent or an alkali. Specific examples thereof include dyes described in European Patent No. 549,489A and Exemplary dyes Ex F2 through 6 described in JP-A No. 7-152129. These dyes are used in cases when processing photographic material in a processing solution and preferably used in cases when thermally developing the photographic material using a processing sheet, as described later. In cases when processed in a processing solution, preferred examples of a dye having absorption in the visible region include dyes AI-1 through 11 described in JP-A No. 3-251840 on page 308. Infrared absorbing dye compounds represented by general formulas (I), (II) and (III) described in JP-A No. 1-280750 page 2, left lower column exhibit preferable spectral characteristics without affecting photographic performance and causing stain due to residual dyes. Specific examples of preferred compounds include compounds (1) through (45) described in the same publication at page 3, left lower column to page 5 left lower column.

Dyes can also be fixed in a binder by allowing the dyes to mordant with a mordant. There can be used mordants and dyes known in the photographic art and examples thereof include mordants described in U.S. Pat. No. 4,500,626, col. 58-59, JP-A No. 61-88256, page 32–41, Nos. 62-244043 and 62-244036. Further, using a reducing agent and a compound releasing a diffusible dye upon reaction with a reducing agent, alkali-movable dye is allowed to be released on development and dissolved in a processing solution or transferred to a processing sheet, as described in U.S. Pat. Nos. 4,559,290 and 4,783,369; European patent No. 220,746A and Kokai Giho No. 87-6119; and JP-A No. 8-101487 paragraph No. 0080 to 0081.

There can also be used decoloring leuco dyes. For example, JP-A No. 1-150132 describes a silver halide photographic material containing a leuco dye, which was previously developed with a developer such as organic acid metal salts. Since the leuco due and the developer complex decolorize upon heating or reaction with an alkali agent, such a combination of the leuco dye and developer is preferred to perform thermal development. There can be employed commonly known leuco dyes, as described in Moriga and Yoshida "Senryo to Yakuhin" vol. 9, page 84 (Kaseihi Kogyokai); "Senryo Binran (Dye Handbook)" page 242 (Maruzen, 1970); R. Garner "Reports on the Progress of Appl. Chem." 56, 199 (1971); "Senryo to Yakuhin" vol. 19, page 230 (Kaseihi Kogyokai); "Shikizai" 62, 288 (1989); "Senryo Kogyo" 32, 208. Preferred examples of the developers include acid clay type developers, phenol formaldehyde resin and organic acid metal salts.

Binder

Binders used in constituting layers of the photographic material or processing material relating to this invention preferably are hydrophilic ones, as described in the foregoing RDs or JP-A 64-13546, pages 71–75. Bonders used in the silver salt photothermographic imaging material are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidine, casein, starch, polyacrylic acid, poly (methyl methacrylate), poly(methylmethacrylic acid), polyvinyl chloride, polymethacrylic acid, copoly(styreneanhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides. Binders used in this invention may be hydrophilic or hydrophobic and transparent hydrophobic binders are used to reduce fogging caused in thermal development, for example, including polyvinyl butyral, cellulose acetate, cellulose acetate-butylate, polyester, polycarbonate, polyacrylic acid, and polyurethane. Of these are preferred polyvinyl butyral, cellulose acetate, cellulose acetate-butylate and polyester. These binders are used alone or in combination thereof. The coating amount is preferably not more than 100 g/m$^2$, and more preferably not more than 20 g/m$^2$.

Hardener

The photographic material or the processing material relating to this invention is preferably hardened with a hardener. In cases where using hydrophilic binders such as gelatin, preferred hardeners include, for example, those described in JP-A Nos. 59-116655, 62-245261, 61-18942, 61-249054, 61-245153, and 4-218044. Specific examples thereof include aldehyde type hardeners (e.g., formaldehyde), azilidine type hardener, epoxy type hardener, inylsulfone type hardener [e.g., N,N'-ethylene-bis (vinylsulfonyl-acetamido)ethane], N-methylol type hardener (e.g., dimethylol urea), boric acid, metaborate and polymeric hardeners (e.g., compounds described in JP-A No. 62-234157). Of these hardeners, vinylsulfone type hardeners and chlorotriazine type hardeners are preferably used alone or in combination. These hardeners are used in an amount of 0.001 to 1 g, and preferably 0.005 to 0.5 g per g of hydrophilic binder.

Support

Supports used in this invention preferably plastic films of polyolefins such as polyethylene and polypropylene, polycarbonates, cellulose acetate, polyethylene terephthalate, polyethylene naphthalate, and polyvinyl chloride. Polystyrene having a syndiotactic structure are also preferred. These can be obtained by methods described in JP-A Nos. 62-117708, 1-46912 and 1-178505. Other support usable in the photographic material relating to this invention include paper supports such as photographic raw paper, printing paper, baryta paper and resin-coated paper, the foregoing plastic films provided with a reflection layer, and supports described in JP-A No.62-253195 (page 29–31). Supports described in the foregoing RD No. 17643, page 28; No. 18716, page 647 right column to page 648, left column; No. 30710, page 879 are preferably used.

The support described above may be subjected to a thermal treatment at a temperature lower than Tg, thereby reducing roll-set curling. Further, the support may be subjected to a surface treatment to enhance adhesion between the support and a sublayer. Specifically, there are employed a glow discharge treatment, UV irradiation treatment, corona discharge treatment and flame treatment. There are also employed supports described in "Kochigijutsu (Known Techniques) No. 5 (Mar. 22, 1991, published by Azutech Co.) page 44–149. Further, transparent supports such as polyethylene naphthalate dicarboxylate and one having, thereon, transparent magnetic material. Supports described in RD No. 308119, page 1009 and Product Licensing Index vol. 92, page 108, item "Support" are also usable. In cases where the photographic material relating to this invention is used in thermal processing, the support used therein needs to be resistant to the processing temperature.

Magnetic Recording Layer

In this invention, in addition to the foregoing supports, support having a magnetic recording layer can be used to record photographic information, as described in JP-A Nos. 4-124645, 5-40321, 6-35092, and Japanese Patent Application Nos. 5-58221 and 5-106979.

Coating an aqueous or organic solvent type coating composition comprising magnetic material particles dispersed in a binder on a support provides the magnetic recording layer. The magnetic material particles used in this invention include ferromagnetic iron oxide such as $\gamma$-$Fe_2O_3$, Co-coated $\gamma$-$Fe_2O_3$, Co-coated magnetite, Co-containing magnetite, ferromagnetic chromium dioxide, ferromagnetic metals, ferromagnetic alloys, hexagonal Ba-ferrite, Sr-ferrite, Pb-ferrite, and Ca-ferrite. Of these, Co-coated ferromagnetic iron oxides such as Co-coated $\gamma$-$Fe_2O_3$ are preferred. Any shape such as needle-like, rice grain-like, spherical, cubic and planar forms is applicable. The specific surface area is preferably not less than 20 $m_2$/g, and more preferably not less than 30 m$^2$/g in terms of SBET. The saturation magnetization ($\sigma$s) of the ferromagnetic material is preferably $3.0\times10^4$ to $3.0\times10^5$ A/m, and more preferably $4.0\times10^4$ to $2.5\times10^5$ A/m. The ferromagnetic material particles may be surface-treated with alumina or organic material. The ferromagnetic material particles may also be surface-treated with a silane coupling agent or titanium coupling agent, as described in JP-A No. 6-161032. Magnetic material particles may also be used, the surface of which is covered with organic or inorganic material, as described in JP-A 4-259911 and 5-81652.

Binders used for magnetic material particles include thermoplastic resin, thermosetting resin, radiation-hardenable resin, reactive resin, acid-, alkali- or bio-degradable polymers, natural polymers (e.g., cellulose derivatives, saccharide derivatives) and their mixtures, as described in JP-A 4-219569. The foregoing resins exhibit a Tg of −40° C. to 300° C. and having a weight-averaged molecular weight of 2,000 to 1,000,000. Specific examples thereof include vinyl type copolymer, cellulose derivatives such as cellulose diacetate, cellulose triacetate, cellulose acetate-propionate, cellulose acetate-butylate, and cellulose tripropionate, acryl resin and polyvinyl acetal resin. Gelatin is also preferred. Of these, cellulose di(or tri)acetate is specifically preferred. Binders can be hardened with an epoxy type, azilidine type, isocyanate type hardeners. The isocyanate type hardeners include, for example, isocyanates such as trilenediisocyanate, 4,4'-diphenylmethanediisocyanate, hexamethylenediisocyanate, and xylylenediisocyanate; reaction producrs of these isocyanates and polyalcohols (e.g., a reaction product of 3 mol trilenediisocyanate and 1 mol trimethylolpropane) and polyisocyanates produced by condensation of these isocyanates, as described in JP-A NO. 6-59357.

A kneader, pin-type mill and annular mill alone or in combination are used to disperse the foregoing magnetic material in the binder. There are usable dispersing agents described in JP-A 5-088283 or known in the art. The thickness of the magnetic recording layer is 0.1 to 10 $\mu$m, preferably 0.2 to 5 $\mu$m, and more preferably 0.3 to 3 $\mu$m. The weight ratio of magnetic material particles to binder is preferably 0.5:100 to 60:100, and more preferably 1:100 to 30:100. The coating amount of magnetic material particles is 0.005 to 3 g/m$^2$, preferably 0.01 to 2 g/m$^2$, and more preferably 0.02 to 0.5 g/m$^2$. A transmission yellow density of the magnetic recording layer is preferably 0.01 to 0.50, more preferably 0.03 to 0.20, and still more preferably 0.04 to 0.15. The magnetic recording layer is provided overall or a stripe form on the back side of the support, by means of coating or printing. The magnetic recording layer can be coated by an air-doctor knife, blade, air knife, squeezing, dipping, reverse roll, transfer roll, gravure, kissing, casting, spraying, dipping, bar and extrusion. Coating solution described in JP-A No. 5-341436 is also preferred.

The magnetic recording layer may further be provided with various functions for enhancing lubrication curl adjustment, antistatic agent, adhesion prevention agent, and head cleaning agent. There may be separately provided a functional layer to perform the foregoing functions.

Non-spherical inorganic particles exhibiting a Mohs hardness of at least 5 are preferably used as an abrasive material in the magnetic recording layer of this invention. The non-spherical inorganic particles are comprised of oxides such as aluminum oxide, chromium oxide, silicon dioxide and titanium dioxide; carbides such as silicon carbide and titanium carbide; or fine powdery diamond. The abrasive material may be surface-treated with a silane coupling agent or titanium coupling agent. The particles may be incorporated into the magnetic recording layer or an over-coat layer on the magnetic recording layer (such as a protective layer or a lubricant layer). Usable binders include the foregoing binders, and binders used in the magnetic recording layer are preferred. Photographic materials provided with a magnetic recording layer are described in U.S. Pat. Nos. 5,336,589, 5,250,404, 5,229,259, 5,215,874; and European patent No. 466,130.

There will be described polyester supports used in the foregoing photographic material provided with a magnetic recording layer and details including photographic material, processing, cartridge and examples thereof are described in Kokai-Giho No. 94-6023 (Mar. 15, 1994, Hatsumei Kyokai). Polyester usable as a support is comprised of a diol and an aromatic dicarboxylic acid as essential components. Examples of the aromatic dicarboxylic acid include 2,6-, 1,5-, 1,4-, or 2.7-naphthalendicarboxylic acid, terephthalic acid, isophthalic acid and phthalic acid; and examples of the diol include diethylene glycol, triethylene glycol, cyclohexane dimethanol, bisphenol A, and bisphenol. Examples of the polymer include homopolymers such as polyethylene terephthalate, polyethylene naphthalate, and polycyclohexane-dimethanol terephthalate. A polyester containing 50 to 100 mol % of 2,6-dicarboxylic acid preferred and polyethylene 2,6-naphthalate is specifically preferred. The average molecular weight is within the range of 5,000 to 200,000. The Tg of the polyester is 50° C. or higher, and preferably 90° C. or higher.

It is preferred to subject the polyester support to thermal treatment to reduce roll-set curling, at a temperature higher than 40° C. and lower than Tg, more preferably a temperature higher than the Tg minus 20° C. and lower than the Tg. The thermal treatment may be carried out at a constant temperature falling within the foregoing range. Alternatively, the thermal treatment is carried out with cooling. The thermal treatment time is 0.1 to 1500 hrs, and preferably 0.5 to 200 hrs. The thermal treatment of the support may be carried out in the roll form or with transporting the web. Surface modification may be achieved by roughening the surface of the support (e.g., by coating fine conductive inorganic particles such as $SnO_2$ or $SbO_2$). It is desirable to provide knurling to the end portion to heighten the end portion, thereby preventing movement of the kerf in the roll core portion. Such thermal treatments may be conducted at any stage, i.e., after film-making of the support, after the thermal treatment, after coating a back layer (e.g., antistatic agent, lubricant) or after subbing, and preferably after coating antistatic agent. A UV absorber may be kneaded in the polyester. Commercially available dyes or pigments used for polyester, such as Diaresin (available from Mitsubishi Kasei Co., Ltd.) and Kayaset (available from Nippon Kayaku Co., Ltd.) are preferably incorporated to prevent light-pumping.

Processing

In this invention, processing may be conducted in accordance with C41 standard process (produced by Eastman Kodak Co.) or the process similar thereto, comprising color developing, bleaching, fixing and stabilizing, and activator processing is also feasible. In this case, it is preferred that the photographic material has characteristics suitable for any one of plural processes.

In this invention, the activator processing means that a color developing agent or a its precursor is included in the photographic material and/or processing material and processing is performed using a solution not containing a color developing agent. Thus, the processing solution contains no color developing agent, which is contained in conventional color developing solution, so that an alkali or auxiliary developing agent may be contained therein. The activator processing is exemplarily described in the prior art literature, for example, European Patent No. 545,491A1 and 565,165A1. The pH of the activator processing solution is preferably 9 or higher, and more 10 or higher.

Auxiliary Developer

In cases where subjecting the photographic material relating to this invention to the activator processing, auxiliary developing agents are used. The auxiliary developing agent refers to material exhibiting a function of promoting electron transfer of from a color developing agent to silver halide in the process of developing silver halide. The auxiliary developing agent may be incorporated into an auxiliary processing solution or included in the photographic material. Development using aqueous alkaline solution containing an auxiliary developing agent is described in RD No. 17643, page 28–29; RD No. 18716, page 651, left column to right column; and RD 30710, page 880–881. The auxiliary developing agents used in this invention preferably are electron-releasing compounds following the Kendall-Pelz rule, such as those represented by general formulas (ETA-I) and (ETA-II) described in JP-A 2002-23296, paragraph No. 0118 to 0123. Of those, the compound represented by formula (ETA-I) is specifically preferred.

Formula (ETA-1)

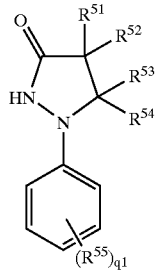

Formula (ETA-2)

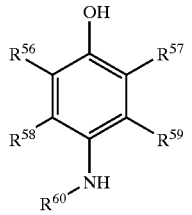

In the above formulas, $R_{51}$ and $R_{52}$ are each a hydrogen atom, an alkyl group, a cycloalkyl group, an alkenyl group, an aryl group or a heterocyclic group.

In cases where allowing an auxiliary developing agent to be included in the photographic material, the auxiliary developing agent may be include in the form of a precursor to enhance storage stability of the photographic material. Examples of a precursor of a developing agent include compounds (ETP-1) through (ETP-97) described in JP-A 2000-89425. These compounds may be dissolved in water or solvents such as alcohol, acetone, dimethylformamide and glycols, dispersed in the form of a dispersion of fine solid particles, or dissolved in a high boiling solvent, followed by being dispersed in a hydrophilic binder, and then coated. These auxiliary developing agent precursors may be used in combination thereof or in combination of auxiliary developing agents.

The silver halide color photographic material relating to this invention preferably contains the foregoing auxiliary developing agent as an electron transfer agent. Preferred electron transfer agents include, for example, the above-described compounds of the general formula (ETA-1) or (ETA-2) described in JP-A 2002-23296. Specific examples of these compounds include compounds described in JP-A 2000-19698, paragraph Nos. 0157 to 0159.

Trapping Agent of Oxidation Product of Developing Agent

The silver halide color photographic material relating to this invention preferably contains a compound capable of forming a substantially colorless upon reaction with an oxidation product of a color developing agent. Specifically, there are preferred a polymeric compound having a repeating unit derive from a monomer represented by the following general formula (I):

formula (I)

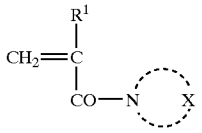

where $R^1$ is a hydrogen atom or an alkyl group; and X is an atomic group necessary to form a heterocyclic ring;

a compound represented by the following formula (II):

formula (II)

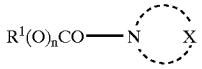

where $R^1$ is an alkyl group, cycloalkyl group, alkenyl group, aralkyl group, aryl group or heterocyclic group, each of which may be substituted; X is an atomic group necessary to form a heterocyclic ring, provided that the heterocyclic ring of

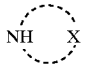

is selected so as to exhibit a pKa of not more than 8; n is 0 or 1; and a compound represented by the following formula (III): formula (III)

$$R^1—(B^1)_n—A^1—O—A^2—(B^2)_m—R^2$$

where $R^1$ and $R^2$ are each an alkyl group, aryl group, aralkyl group or a heterocyclic group, which may be respectively substituted, or $R^1$ and $R^2$ combine with each other to form a ring; $A^1$ and $A^2$ are each a carbonyl group or sulfonyl group; $B^1$ and $B^2$ are each an oxygen atom or N—R, in which R is a hydrogen atom or an alkyl group; n and m are each 0 0r 1.

Examples of the foregoing compounds include those described in JP-A Nos. 01-193855, 01-283559, 01-283558, JP-B No. 4-73722 and Patent No. 2699005. These compounds may be incorporated into an emulsion layer or an interlayer not containing an emulsion.

Thermal Processing

In one preferred embodiment of this invention, the photographic material relating to this invention is thermally developed. Heating the photographic material as it is or heating with a superposition of other processing material performs thermal developing. The processing material is a sheet having on a support a processing layer containing a base and/or base precursor, as described later. The processing layer preferably comprises a hydrophilic binder. After imagewise exposed, the photographic material is heated together with the processing material to perform image formation, while laminating the light-sensitive layer side of the photographic material to the processing layer side of the processing material. It is preferred that after supplying water to the photographic material or the processing material in an amount of 1/10 to 30 times water necessary for the maximum swell of the total layers of the photographic material and processing material, the photographic material and the processing material are laminated and heated to perform color development. The foregoing auxiliary developing agent may optionally be included in the photographic material or the processing material or coated thereon together with water.

Thermally processing photographic materials is commonly known in the photographic art and photographic material and process thereof are detailed, for example, in "Shashin-Kogaku no Kiso" (Fundamentals of Photographic Engineering, 1970, Corona Co.) page 553–555; Nebletts, Handbook of Photography and Reprography, $7^{th}$ Ed. (Van Nostrand and Reinhold Company), page 32–33; U.S. Pat. Nos. 3,152,904, 3,301,678, 3,392,020 and 3,457,075; British Patent Nos. 1,131,108 and 1,167,777; and RD No. 17029 (June, 1978) page 9–15. The heating temperature in the thermal development is 50 to 250° C., and preferably 60 to 150° C.

To promote thermal development, a thermal solvent may be incorporated into the photographic material. The thermal solvent refers to a compound capable of being liquefied on heating and promoting image formation. The thermal solvent is preferably white-colored and solid at ordinary temperature, and is also desirable to less volatile. The melting point is preferably 70 to 170° C. Examples thereof include polar organic compounds described in U.S. Pat. Nos. 3,347,675 and 3,667,959. Specific examples include amide derivatives (e.g., benzamide), urea derivatives (e.g., methylurea, ethylene urea), sulfoneamide derivatives (e.g., compounds described in JP-B Nos. 1-40974 and 4-13701), polyol sorbitans, and polyethyelene glycols. Other thermal solvents usable in this invention include compounds described in U.S. Pat. Nos. 3,347,675, 3,438,776, 3,666,477 and 3,667,959; RD No. 17643; JP-A Nos. 51-19525, 53-24829, 53-60223, 58-118640, 58-198038, 59-68730, 59-84236, 59-229556, 60-14241, 60-191251, 60-232547, 61-52643, 62-42153, 62-44737, 62-78554, 62-146645, 62-139545, 63-53548, 63-161446; JP-A Nos. 1-224751, 1-227150, 2-863, 2-120739 and 2-123354. Further, examples of preferred thermal solvents are also compounds TS-1 through TS-21 described in JP-A 2-297548, page 8, upper left to page 9, upper left. The foregoing thermal solvents may be used in combination thereof.

In the photographic material and/or processing material, a base or its precursor is preferably used to promote silver development or dye forming reaction. Base precursors include, for example, a salt of an organic acid capable of decarboxylation on heating and a base and a compound capable of releasing amines through intramolecular nucleophilic substitution, Lossen rearrangement or Beckmann arrangement. Specific examples thereof are described in U.S. Pat. Nos. 4,514,493 and 4,657,848; "Kochigijutsu (Known Techniques) No. 5 (Mar. 22, 1991, published by Azutech Co.) page 55-86. There is also preferably employed a method for generating a base, in which a sparingly water-soluble basic metal compound is combined with a compound capable of forming a complex with the metal ion forming this basic metal compound (also called complexing compound) in water as medium. Such a method for generation a base is described in European Patent No. 210,660 and U.S. Pat. No. 4,740,445. In such a case, the sparingly water-soluble basic metal compound is incorporated to the photographic material and the compound capable of forming a complex with the metal ion forming the basic metal compound (also called complexing compound) is incorporated to the processing material. Such a constitution preferably enhances storage stability of the photographic material.

Processing Material

The processing material used in the thermal development relating to this invention, in addition to incorporating a base and/or its precursor described above, has functions of shielding from air during thermal development, preventing evaporation of material from the photographic material, supplying material used for processing other than the base to the photographic material or removing ingredients which is not needed after development (such as yellow filter dye and antihalation dye) or unwanted components produced during development. There may be incorporated a color developing agent and/or its precursor in the processing material. The processing material may have a function of desilvering. For example, in cases where the exposed photographic material is superposed on the processing material to solubilize a part or all of silver halide and/or developed silver, a fixing agent, as a solvent for silver halide may be contained in the processing material.

The binder and support used in the processing material may be the same as used in the photographic material. The processing material may be added with a mordant for the purpose of remove dyes described above. There can be employed mordants commonly known in the photographic art. Examples thereof include those described in U.S. Pat. No. 4,500,626 col. 58–59, JP-A No.61-88256, page 32–41, JP-A Nos. 62-244043 and 244036. There may be used a dye-receptive polymer compounds described in U.S. Pat. No. 4,463,079. The foregoing thermal solvents may be contained.

The processing layer of the processing material may contain a base or its precursor. There may be used any one of organic bases and inorganic bases. Examples of the inorganic base include an alkali metal or alkaline earth metal hydroxide (e.g., potassium hydroxide, sodium hydroxide, lithium hydroxide, calcium hydroxide, magnesium hydroxide), phosphate (e.g., secondary and tertiary phosphates such as dipotassium hydrogen phosphate, disodium hydrogen phosphate, and ammonium sodium hydrogen phosphate), carbonate (e.g., potassium carbonate, sodium carbonate, sodium hydrogen carbonate, magnesium carbonate), borate (e.g., potassium borate, sodium borate, sodium metaborate); organic acid salts (potassium acetate, sodium acetate, potassium oxalate, sodium oxalate, potassium tartrate, sodium tartrate, sodium malate, sodium palmitate, sodium stearate); and alkali metal or alkaline earth metal acetylide, as described in JP-A No. 63-25208.

Examples of the organic base include ammonia, aliphatic or aromatic amines, such as primary amines (e.g., methylamine, ethylamine, butylamine, n-hexylamine, cyclohexylamine, 2-ethylhexylamine, allylamine, ethylenediamine, 1,4-diaminobutane, hexamethylenediamine, aniline, anisidine, p-toluidine, α-naphthylamine, m-phenylenediamine, 1,8-diaminonaphthalene, benzylamine, phenethylamine, ethanolamine), primary amines (e.g., dimethylamine, diethylamine, dibutylamine, diallylamine, N-methylaniline, N-methylbenzylamine, N-methylethanolamine, diethanolamine), tertiary amines (e.g., N-methylmorpholine, N-hydroxyethylmorpholine, N-methylpiperidine, N-ethylpiperidine, N-hydroxyethylpiperidine, N,N'-dimethylpiperadine, N,N'-dihyxyethylpiperadine, diazabicyclo[2,2,2]-octane, N,N-dimetylethanolamine, N,N-dimethylpropanolamine, N-methylethanolamineN-methyldipropanolamine, triethanolamine, N,N,N',N'-tetramethylethylenediamine, N,N,N',N'-tetrahyroxyethylethylenediamine, N-methylpyrrolodine), polyamines (e.g., diethylenetriamine, triethylenetetramine, polyethyleneimine, polyallylamine, polyvinylbenzylamine, poly-(N,N-diethylaminoethyl methacrylate), poly-(N,N-dimethylvinylbenzylamine)), hydroxyamines (e.g., hydroxylamine, N-hydroxy-N-methylaniline), heterocyclic amines (e.g., pyridine, lutidine, imidazole, aminopyridine, N,N-dimethylaminopyridine, indole, quinoline, isoquinoline, poly-4-vinylpyridine, poly-2-vinylpyridine), amidines (e.g., monoamidines such as acetoamidine, imidazotane, 2-methylimidazole, 1,4,5,6-tetrahydropyrimidine, 2-methyl-1,4,5,6-tetrahydropyrimidine, 2-phenyl-1,4,5,6-tetrahydropyrimidine, iminopiperidine, diazabicyclononene, diazabicycloundedecene), bis, tris or tetraamidine guanines (e.g., water-soluble monguanines such as guanine, dimethylguanine, tetramethylguanine)2-aminoimidazoline, 2-amino-1,4,5-tetrahydropyrimidine), as described in JP-A No. 62-170954; water-insoluble mono or bisguanine, bis, tris or tetraguanidine, quaternary ammonium hydroxides (e.g., tetramethylammonium hydroxide, tetraethylammonium hydroxide, tetrabutylammonium hydroxidetrimehylbenzylammonium oxide, triocylmethylammonium oxide, methylpyridinium hydroxid), as described in JP-A No. 63-70845.

In cases when a complex-forming (or complexing) compound for a metal ion of a sparingly water-soluble basic compound is used for a base precursor, there can be used aminocarboxylic acids such as ethylenediaminetetraacetic acid, nitrilotriacetic acid, and diethylenetriamine-pentaacetic acid or their salts; aminophosphonic acids and their salts; pyridylcarboxylic acids or their salts such as 2-picolinic acid, pyridine-2,6-dicarboxylic acid and 5-ethyl-2-picolinic acid; and iminodiacetic acids and their salts such as benzylimonodiacetic acid and α-picolyliminodiacetic acid. The complex-forming compound is used preferably in the form of a salt neutralized with an organic base such as guanidine or alkali metal. The base or its precursor is preferably incorporated in the processing material, in an amount of 0.1 to 20 $g/m^2$, and more preferably 0.5 to 10 $g/m^2$.

The base or its precursor may be incorporated in the photographic material. In cases where the sparingly water-soluble basic compound is incorporated in the photographic material, a metal hydroxide or metal oxide is preferably used, and zinc hydroxide and zinc oxide are specifically preferred.

In thermal development using the processing material, it is preferred to use a small amount of water (also denoted as aqueous medium) to promote development, transfer of processing ingredients or diffusion of unwanted material. Specifically, water is indispensable in cases when the sparingly water-soluble basic compound is used in combination with a complexing compound capable of forming a complex with the metal ion of the basic compound. The water may contain an inorganic alkali metal salt, an organic base, a low boiling solvent, a surfactant, an antifoggant, a compound capable of forming a complex with a sparingly water-soluble metal compound, an anti-mold or a fungicide. There may be usable any generally used water. Examples thereof include distilled water, tap water, well water and mineral water. In a thermal processing apparatus using the photographic material and processing material, water may be disposed of or repeatedly used by recycling. In the latter case, water containing ingredients leached out of the material is used. There may be used apparatuses or water described in JP-A Nos. 63-144354, 63-144355, 62-38460 and 3-210555. Water may be provided to the photographic material or processing material alone or to both of them. Water is provided in an amount of 1/10 to 30 (preferably 1/10 to 1) times the amount necessary to allow all layers of the photographic material and processing material other than their backing layers to maximally swell. Methods, for example, described in JP-A No. 62-253159, page 5 and JP-A No. 63-85544 are preferably employed to provide water. A solvent may be included in microcapsules. Alternatively, water may be includes, in a hydrate form, in the photographic material or the processing material, or both of them. The temperature of water to be provided is 30 to 60° C., as described in JP-A No. 63-85544.

Thermal Processing Apparatus

Commonly known heating means are applicable to thermally develop photographic materials relating to this invention. Examples thereof include a system of being brought into contact with a heated heat-block or face-heater, a system of being brought into contact with a heated roller or drum, a system of being brought into contact with an infrared or far-infrared lamp heater, a system of being allowed to pass through an atmosphere maintained at a high temperature and a system of using high frequency heating. Alternatively, a backing layer containing a heat-generating conductive layer, such as a carbon black layer is provided on the back side of the photographic material or processing material, in which Joule's heat produced by energization is employed to perform thermal development. There may also be employed a heating element described in JP-A No. 61-145544. Superposition of the photographic material on the processing material in which the light-sensitive layer faces the processing layer can be conducted in such a manner as described in JP-A No. 62-253159 and No. 61-147244, page 27. The heating temperature is preferably 43 to 100° C.

Commonly known thermal processing apparatuses are applicable to the color image forming method in this invention. Preferred examples thereof include apparatuses described in JP-A Nos. 59-75247, 59-177547, 59-181353, 60-18951, 62-25944, 6-130509, 6-95338, 6-95267, 8-29954 and 8-29955. There are also commercially available apparatuses, such as Pictrostatt 100, Pictrostatt 200, Pictrostatt 300, Pictrostatt 330, Pictrostatt 50, Pictrography 3000 and Pictrography 2000 (all of which are available from Fuji Film Co. Ltd.).

Thermal Development, Desilvering and Fixing

In the color image forming method relating to this invention, a development-stopping agent, which is included in the processing element may be allowed to concurrently act with development. The development-stopping agent refers to a compound having the function of lowering the base concentration in the layer to inhibit development, immediately after completion of proper development, upon neutralization of or reaction with the base, or a compound capable of inhibiting development upon interaction with silver or a silver salt. Specific examples thereof include an acid precursor capable of releasing an acid upon heating, an electrophilic compound or one capable of causing substitution reaction with a co-existing base on heating, a nitrogen-containing compound, and a mercapto compound or its precursor. More specifically, these are described in JP-A No. 62-253159, page 31–32. Further, a combination in which a zinc salt of a mercaptocarboxylic acid, as described in JP-A No. 8-56062, is contained and a processing element in which the complexing compound described earlier is also advantageous. Similarly, a print-out preventing agent may be allowed to be included in the processing element and to concurrently display its function with development. Examples of the print-out preventing agent include monohalogen compounds described in JP-B No. 54-164, trihalogen compounds described in JP-A No. 53-46020, compounds containing a halogen attached to an aliphatic carbon atom, as described in JP-A No. 48-45228, and polyhalogen compounds as represented by a tetrabromoxylene, described in JP-B No. 57-8454. A development inhibitor such as 1-phenyl-5mercaptotetrazole is effective, as described in British patent No. 1,005,144. A viologen compound described in JP-A No. 8-184936 is also effective. The print-out preventing agent is preferably used in an amount of $1\times10^{-4}$ to 1 mol/mol Ag, and more preferably $1\times10^{-3}$ to $1\times10^{-1}$ mol/mol Ag.

In the thermal process relating to this invention, developed silver produced in thermal processing of the photographic material can be removed by allowing an oxidizing agent for silver, capable of acting as a bleaching agent for the developed silver to be included and to act simultaneously with or with a time lag for the development reaction. Alternatively, after completion of development to form images, a second material containing an oxidizing agent for silver is laminated with the photographic material to perform removal of developed silver.

Conventionally used silver bleaching agents are usable as a bleaching agent used in the processing material relating to this invention. Such bleaching agents are described in U.S. Pat. Nos. 1,315,464 and 1,946,640, and Photographic Chemistry Vol. 12, chapter 30, (Foundation Press, London, England). These bleaching agents effectively oxidize silver images to solubilize them. Examples of effective silver bleaching agents include an alkali metal dichromate and an alkali metal ferricyanide. Specifically, preferred silver bleaching agents are water-soluble, including, for example, ninhydrin, indanedione, hexaketosiloxane, 2,4-dinitrobenzoic acid, benzoquinone, benzenesulfonic acid and 2,5-dinitrobenzoic acid. There are also included metal complex salts such as a cyclohexyldialkylaminotetraacetic acid iron (III) salt, ethylenediaminetetraacetic acid iron (III) salt, and citric acid iron (III) salt. With regard to a binder, support and other additives used in the second processing material, the same materials as used in the processing material (first processing material) are usable.

The coating amount of the bleaching agent, which is variable depending on silver coverage of the photographic material to be superposed, is usually within the range of 0.01 to 10 mol, preferably 0.1 to 3 mol, and more preferably 0.1 to 2 mol per mol of silver coverage per unit area.

A compound having fixing capability may be contained in the processing material to remove silver halide which has become unnecessary after completion of image formation. Specific examples of such a system include one in which physical development nucleuses and a silver halide solvent are allowed to be included in the processing material, solubilizing silver halide in the photographic material during heating to fix it in the processing layer. The thus solubilized silver halide that has diffused from the photographic material is reduced on the physical development nucleuses to form physical-developed silver and is fixed in the processing layer. There are commonly known physical development nucleuses, including, for example, heavy metals such as zinc, mercury, lead, cadmium, iron, chromium, nickel, tin, cobalt, copper, and ruthenium, noble metals such as palladium, platinum, silver and gold, and colloidal particles of chalcogen compounds such as sulfur selenium and tellurium. These physical development nucleus materials can be obtained in such a manner that corresponding metal ions are reduced by reducing agents such as ascorbic acid, sodium borohydride and hydroquinone to form a metal colloidal dispersion, or a soluble sulfide, selenide, or the metal ions are mixed with telluride solution to form a colloidal dispersion comprised of water-insoluble metal sulfide, metal selenide or metal telluride. The dispersion is preferably formed in a hydrophilic binder such as gelatin. Preparation of colloidal silver particles is described in U.S. Pat. No. 2,688,601. Desalting may optionally be performed to remove excessive soluble salts, as is known in the silver halide emulsion making. The physical development nucleus size is preferably 2 to 200 nm. The physical development nucleuses are preferably contained in the processing layer, in an amount of $1\times10^{-3}$ to 100 mg/m$^2$, and more preferably $1\times10^{-2}$ to 10 mg/m$^2$. The physical development nucleuses are separately prepared and added into a coating solution. Alternatively, for example, silver nitrate and sodium sulfide, or gold chloride and a reducing agent are reacted in a solution containing a hydrophilic binder. Preferred examples of the physical development nucleus include silver, silver sulfide and palladium sulfide.

In cases when fixing silver halide in the foregoing system, it is necessary to allow a reducing agent capable of causing physical development to exist in the layer containing physical development nucleuses. A non-diffusible reducing agent needs to be incorporated into the layer. A diffusible reducing agent, however, may be incorporated in any layer of the photographic material and the processing material. As a reducing agent having such a function are used the auxiliary developing agent described earlier. Alternatively, silver halide may be fixed without using the physical development nucleuses or a reducing agent. Thus, using so-called silver halide solvents, salt displacement is performed with respect to a silver ion to form a light-insensitive silver salt.

In any cases described above, commonly known silver halide solvents are usable, such as compounds generally known as a silver solvent or a fixing agent. Examples thereof include a thiosulfate, sulfite, thiocyanate, thioether compound such as 1,8-di-3,6-dithiaoctane or 2,2'-thiodiethanol, 6,9-dioxa3,12-dithiatetradecane-1,14-diol, 5- or 6-membered imido-ring containing compound such as uracil or hydantoin, as described in JP-A No. 8-179458, mercapto compound, thiouracils, nitrogen-containing heterocyclic compounds having a sulfide group, as described in JP-A No. 4-365037, page 11–21, and compounds represented by general formula (1) described in JP-A No. 53-144319. There are usable trimethyltriazolium thiolate or meso-ion thiolate compound, described in Analytica Chemica Acta, vol. 248, page 604–614 (1991). A compound capable of fixing silver halide to perform stabilization thereof, as described in JP-A No. 8-69097 is also usable as a silver halide solvent. Further, a fixing agent soluble at a temperature different from that of development is usable, as described in U.S. patent Ser. No. 2002/9678. These silver halide solvents may be used in combination thereof. Of the foregoing compounds, a sulfite, and a 5- or 6-membered imido-ring containing compound such as uracils or hydantoins are preferred. Specifically, incorporating the uracils or hydantoins in the form of a potassium salt preferably improves lowering in glossiness after raw stock keeping of the processing material.

The total content of the silver halide solvent in the processing layer is preferably 0.01 to 100 mmol/m$^2$, more preferably 0.1 to 50 mmol/m$^2$, and still more preferably 1 to 30 mmol/m$^2$. The molar ratio to silver coverage of the photographic material preferably is 1/20 to 20, more preferably 1/10 to 10, and still more preferably 1/3 to 3. The silver halide solvent may be added to a coating solution, through solution in a solvent such as water, methanol, ethanol, acetone, dimethylformamide, or methyl propyl glycol or in an aqueous alkali or acid, or in the form of a solid particle dispersion.

The processing material preferably has at least one timing layer. The timing layer aims to retard a bleaching or fixing reaction until substantial completion of the intended reaction between the silver halide and a developing agent, followed by reaction with a coupler. The timing layer may be comprised of gelatin, polyvinyl alcohol, or poly[(vinyl alcohol)-co-(vinyl acetate)]. This layer may be a barrier timing layer, as described in U.S. Pat. Nos. 4,056,394 and 4,061,496.

In the color image forming method relating to this invention, at least two processing materials having separated functions, such as a first processing material to perform color development and a second processing material to perform bleaching and/or fixing can be successively superposed on the photographic material to achieve thermal processing. In this case, it is preferred that the processing material to perform color development does not contain the compound capable of bleaching and/or fixing, as described above. The photographic material is superposed onto the first processing material to perform thermal development, followed by being superposed on the second processing material to perform bleaching so as to cause the light-sensitive layer of the photographic material to face the processing layer of the second processing material. In this case, water is provided to the photographic material or the processing material in an amount of 0.1 to 30 times the amount necessary to swell the total layers of the photographic material and processing material other than the backing layers. Such a state is subjected to heating at a temperature of 40 to 100° C. for a period of 5 to 60 sec. to conduct bleaching and fixing treatments. The amount or kind of water, the method of providing water and method for superposing the photographic material onto the processing material are applicable, similarly to that of the processing material to perform development.

To employ photographic material, after being processed, for the purpose of storage or visual appreciation over a long period of time, it is preferred to subject the photographic material to at least one treatment selected from a process to remove silver halide, such as the foregoing bleaching or fixing, and a process to remove light-insensitive silver compound. Herein, the light-insensitive silver compound refers to developed silver, colloidal silver or organic silver salt. In cases when the photographic material, after being processed, is read by a scanner for conversion to electronic images, the bleaching or fixing process is not necessarily required. However, it is preferred to conduct the fixing process. Further, in cases where the processed color negative film is returned to a customer as a recording medium, as described in U.S. patent Ser. No. 2002/18944, WO Nos. 01/96943, 01/96945 and 01/96947, images of the thermally developed photographic material are read by a scanner and it is preferred that the images, after being bleached or fixed, be again read by the scanner. This is because remaining silver halide, which has an absorption within the visible wavelength region and becomes a noise source at the time of being read by a scanner, adversely affecting the obtained electronic images. To achieve a simplified process by conducting development alone without fixing, it is preferred to use thin tabular silver halide grains or silver chloride grains. It is also preferred to employ a low silver photographic material having a silver coverage of 0.1 to 4.5 g/m$^2$, as described in U.S. Pat. Ser. No. 2002/12887. Further, it is also preferred to employ photographic material containing substantially no colored coupler.

Other Material

In the photographic material or processing material relating to this invention, various surfactants can be used for the purpose of coating aid, improvements in peeling or lubrication, antistatic agent or development acceleration. Specific examples of the surfactants are described in "Kochigijutsu (Known Techniques) No. 5 (Mar. 22, 1991, published by Azutech Co.) page 136–138, and JP-A Nos. 62-173463 and 62-183457. The photographic material may be added with an organic fluoro-compound. Representative examples of the organic fluoro-compound include fluorinated surfactants described in JP-B No. 57-9053, 8-17 columns and JP-A Nos. 61-20944 and 62-135826; oily fluorine containing compounds such as fluorinated oil, and solid fluororesin such as tetrafluoroethylene.

The photographic material and processing material preferably exhibit lubrication. Lubricants are contained in both sides of the light-sensitive layer and backing layer. The expression, preferably exhibiting lubrication means exhibiting a dynamic friction coefficient of 0.01 to 0.25. The dynamic friction coefficient is determined in terms of a value obtained when transported on stainless steel balls of 5 mm diameter at a speed of 60 cm/min (in an atmosphere of 25° C. and 60% RH). Examples of preferred lubricants include a polyorganosiloxane, higher fatty acid amide, and ester of higher fatty acid and higher alcohol. Specific examples of the polyorganosiloxane include polydimethylsiloxane, polydiethylsiloxane, polystyrylmethylsiloxane and polymethylphenylsiloxane. Of these, polymethylsiloxane and a long chain alkyl group containing ester are specifically preferred. The lubricant is preferably incorporated into the outermost layer on the emulsion layer side or the backing layer.

The photographic material or processing material relating to this invention preferably contains an antistatic agent. Examples of the antistatic agent include a carboxylic acid or carboxylate, a sulfonate-containing polymer, a cationic polymer and ionic surfactant compounds. The preferred antistatic agent is at least one selected from ZnO. $TiO_2$, $SnO_2$, $Al_2O_3$, $In_2O_3$, $SiO_2$, MgO, BaO, $MoO_3$, and $V_2O_5$. Specifically preferred are fine particulate crystalline metal oxide or its composite oxide (of Sb, P, B, In, S, Si, C) exhibiting a volume resistance of not more than $10^7$ Ω·cm, and more preferably not more than $10^5$ Ω·cm and having a particle size of 0.001 to 1.0 μm. The antistatic agent is incorporated in the photographic material, preferably in an amount of 5 to 500 mg/m$^2$, and more preferably 10 to 350 mg/m$^2$. The ratio of such a conductive crystalline oxide or its composite oxide to a binder preferably is within the range of 1:300 to 100:1, and more preferably 1:100 to 100:5.

In the constitution of the photographic material and processing material, it is preferred to allow various polymer latexes to be included for the purpose of improving physical properties of the layer, such as dimensional stability, anti-curling, and prevention of adhesion, cracking, or pressure sensitization or desensitization. Specific examples of a polymer latex usable in this invention include those described in JP-A Nos. 62-245258, 62-136648 and 62-110066. Specifically, incorporation of a polymer latex exhibiting a relatively low glass transition point (for example, not higher than 40° C.) in the mordant layer prevents cracking of the layer. On the other hand, the use of a polymer latex exhibiting a relatively high glass transition point in the back layer results in curl prevention.

The photographic material or the processing material preferably contains a matting agent. The matting agent may be incorporated in any of the emulsion layer side and the back layer side and preferably in the outermost layer of the emulsion layer side. The matting agent may be one soluble in processing solution or an insoluble one, while the combined use thereof is preferred. For example, particulate poly(methyl methacrylate), particulate poly(methyl methacrylate/methacrylic acid=9/1 or 5/5 in molar ratio) and particulate polystyrene are preferred. The particle size of the matting agent preferably is 0.8 to 10 μm. A narrow particle size distribution is preferred, and at least 90% of the total particle number preferably falling within the range of 0.9 to 1.1 times of the mean particle size. Examples thereof include polymethyl methacrylate (0.2 μm), poly(methyl methacrylate/methacrylic acid=9/1 in molar ratio, 0.3 μm), and polystyrene (0.25 μm). Other specific examples thereof are described in JP-A No. 61-88256, at page 29. Further are usable compounds described in JP-A Nos. 63-274944 and 63-274952, such as benzoguanamine resin beads, polycarbonate resin beads and ABS resin beads. There are also usable compounds selected from those referred to in the Research Disclosure described earlier.

Film Form

Next, description will be given of a film cartridge used for packing photographic material. The main material of the film cartridge used in this invention may be metal or synthetic plastic. Examples of preferred plastic material include polystyrene, polyethylene, polypropylene, and polyphenyl ether. The cartridge material may contain various antistatic agents. Preferred antistatic agents include carbon black, metal oxide particles, nonionic, anionic, cationic or betaine type surfactants and polymer particles. The thus antistatic cartridge is described, for example, in JP-A Nos. 1-312537 and 1-312538. The resistance at 25° C. and 25% RH preferably is not more than $10^{12}$ Ω. The plastic cartridge is usually prepared by using plastic mixed with carbon black or pigments, which serves for light-shielding. The cartridge may be a 135-size. Down-sizing the 25 mm diameter of the 135 mm size cartridge to 22 mm or less is effective to perform miniaturization of the camera. The internal volume of the cartridge is to be not more than 30 cm$^3$, and preferably not more than 25 cm$^3$. The weight of the cartridge preferably is 5 to 15 g. There is usable a cartridge, in which film is advanced by rotating a spool. A cartridge is also usable, in which the top of the film which is housed inside of the cartridge is advanced by rotating the spool axis in the direction of advancing the film. Cartridges having such a structure are described in U.S. Pat. Nos. 4,834,306 and 5,226,613.

The photographic material relating to this invention may also be packed in a commercially available lens-fitted film package. For example, the photographic material can be packed in a lens-fitted film package described in Japanese Patent Application No. 10-158427, and JP-A Nos. 11-352564 and 2000-19607.

On the outer portion of the film cartridge or lens-fitted film package, the applicable process is previously denoted, for example, such as "For Use in Thermal Processing" or an indication of the processing fee being previously deposited is specified.

In this invention, waste material or waste liquid produced in the processing stage can be recovered as a resource. Specifically, in the case of obtaining digital image information by reading the processed photographic material using a scanner, efficient resource recovery from the photographic material can be achieved. In this case, almost the total amounts of silver compounds incorporated in the photographic material can be recovered, which is best for environmental friendliness and the reuse of expensive raw materials.

Recovery of processed photographic materials may be performed in a system of recovering photographic materials accumulated in a photofinishing laboratory or a processing apparatus, or in a system of sending recoverable photographic material to firms dealing recovering treatments.

In this invention, the reclaimed material is promarily silver from photographic material. Hereinafter, silver recovery will be described. To recover silver from processed photographic materials, the photographic materials are subjected to desilvering to obtain a solution containing soluble silver salts, from which silver is eventually recovered. In this case, the silver recovery can be conducted, while maintaining the form of the film, which is advantageous for separating silver as recovering resource from a film base. Resource recovery can also be conducted in a state of silver remaining partially or overall in the photographic material. There are applicable commonly known methods for separating or recovering silver from solutions containing soluble silver salts. Examples thereof include a method in which a base metal, which exhibits a larger ionization tendency than silver is allowed to contact the solution to substitute dissolved silver, and also an electrolytic method in which silver is deposited through electrolysis. Electrolytic silver recovery is described in, for example, JP-A No. 50-98837, 52-26315, 52-115723, 53-32869 and 53-60391; German Patent No. 2,333,018 and 2,429,288; Belgian Patent. No. 780,623, U.S. Pat. Nos. 3,400,056, 3,840,056, 3,964,990 and 4,069,127. Methods described therein include a method in which a reducing agent is added with varying an electric potential to perform electrolysis, a method of using a diaphragm, electrodialysis, a method of automatically controlling electrical current and techniques for improving a solution supply, stirring and devices such as an electrode or electrode plate.

In addition to the foregoing silver recovery methods, the use of basic ion exchange resin is described in, for example, JP-A Nos. 49-70823 and 51-17114; and German Patent No. 2,630,661. Further, silver recovery methods effectively applicable in this invention include an electrolysis method (described in French Patent No. 2,299,667), a precipitation method (described in JP-A No. 52-73037 and German patent No. 2,331,220), an ion exchange method (described in German Patent No. 2,548,237) and a metal substitution method (described in British Patent No. 1,353,805).

Ion exchange resins usable in the foregoing ion exchange method for silver recovery preferably are anionic ion exchange resins in which a functional group is attached to a three-dimensionally poly-condensed polymeric substrate. Examples of the polymeric substrate include styrene divinyl benzene copolymer, methacrylate or acrylate and divinyl benzene copolymer, and phenol-formalin resin. The functional group is, for example, a quaternary ammonium group or primary-tertiary amine salt structures. Chelating resins include an iminodiacetic acid type, polyamine type, amidoxime type, aminophosphoric acid type, pyridine type and dithiocarbamic acid type. The foregoing ion exchange resin is also commercially available a trade name as Diaion from Mitsubishi Chemical Corp., Amberlite from ORGANO CORP., Duolite and Sumikaion from SUMITOMO CHEMICAL CO. LTD.

Specific examples of anionic ion exchange resins include (i) strongly basic anionic exchange resins, such as Mitsubishi Diaion SA-11A, Mitsubishi Diaion PA-308, Mitsubishi Diaion SA-20A, Mitsubishi Diaion SA-21a and Mitsubishi diaion PA-408;

(ii) weakly basic ion exchange resins, such as Mitsubishi Diaion WA-10, Mitsubishi Diaion WA-11, Mitsubishi Diaion WA-20, Mitsubishi Diaion WA-21 and Mitsubishi Diaion WA-30. Anionic substituents of the foregoing basic ion exchange resins are not specifically limited and preferred examples thereof include $OH^-$, $Cl^-$, $SO_4^{2-}$, $Br^-$, $COO^-$, $CO_3^{2-}$ and $SO_3^-$. Of the foregoing anionic ion exchange resins, weakly basic ion exchange resins are preferred in this invention.

Exposure Method

In cases where the photographic material relating to this invention is used as camera material, it is popular that scenes or people are directly photographed using a camera. The foregoing case of photographic material being packed in a lens-fitted film package is included in this. Further, the photographic material is employed in exposure of reversal film or negative film using a printer or an enlarger; scanning exposure of an original picture through a slit using an exposure apparatus of a copying machine; scanning exposure by allowing a light-emitting diode or various laser (e.g., laser diode, gas laser) to emit via image information and electric signals (as described in JP-A Nos. 2-129625, 5-176144, 5-199372, 6-127021); and direct exposure or exposure through an optical system outputting image information on an image displaying device such as a CRT, liquid crystal display, electroluminescence display or plasma display.

Examples of a light source used for recording images on the photographic material include natural light, tungsten lamp, light-emitting diode, laser light source, CRT light source, and light sources described in U.S. Pat. No. 4,500, 626 and JP-A Nos. 2-53378 and 2-54672. There is also feasible imagewise exposure using a wavelength conversion element combining non-linear optical material and a coherent light source such as laser light. The non-linear optical material refers to material capable of displaying non-linearity of an electric field and depolarization produced when a strong light electric field such as laser light is given. Examples thereof include inorganic compounds such as lithium niobate, potassium dihydrogen phosphate (KDP), lithium iodate, and $BaB_2O_4$, urea derivatives, nitroaniline derivatives, nitropyridine-N-oxide derivatives such as 3-methyl-4-nitropyridine-n-oxide (POM), and compounds described in JP-A Nos. 61-53462 and 62-210432. Wavelength conversion elements known in the art include a single crystal light guide type and a fiber type, both of which are useful.

As the image information described above are employed image signals obtained by a video camera or electronic still camera, television signals such as Japanese television signal standard (NTSC), image signals obtained by dividing an original picture into a large number of picture elements and images produced by using a computer, such as CG and CAD.

Scanner Read-In

In this invention, obtained images can be read using a scanner and transformed to electronic image information. The scanner refers to a device in which photographic material is optically scanned to convert the reflection or transmission density to image information. It is typical to scan an intended portion of photographic material by moving the optical portion of the scanner in a direction different from the moving direction of the photographic material. Alternatively, the photographic material may be fixed, while moving only the optical portion of the scanner, or the optical portion may be fixed, while moving only the photographic material. The combinations thereof are also feasible.

To read image information of photographic material, it is preferred to determine the amount of reflection or transmission light by overall exposure or slit scanning exposure of light having wavelengths corresponding to the respective absorptions of at least three dyes. In this case, it is preferred to use diffused light rather than collimated light to remove information due to a matting agent or flaws in the film. It is also preferred to use a semiconductor image sensor (e.g., area-type CCD, CCD line-sensor) in the light receiving section. Image formation, as described in U.S. Pat. Nos. 5,465,155, 5,519,510 and 5,988,896 is also feasible, in which developed silver images or infrared dye images formed in photographic material are detected with infrared light to form images. U.S. patent Ser. Nos. 2001/31144, 2001/52932 and 2001/43812 disclose imaging by the combination of images read by the respective visible and infrared scanners.

The thus obtained image data can be visualized using various image display devices. Any image display device is usable, including a color or monochromatic CRT, liquid crystal display, plasma emission display and EL display.

The thus read image signal is outputted to form an image on a recording material. Not only silver halide photographic material but also other material are employed to output images. There are also employed various hard copying devices to output images, including an ink-jet system, sublimation type thermal transfer system, electrophotography system, Cycolor system, thermoautochrome system, a system of exposure onto silver halide color paper and silver halide photothermographic system. Any one of the foregoing can display the effects of this invention.

The main intent of this invention is to incorporate image information obtained by development as digital data and photographing information may be optically outputted onto print material such as photographic color print paper in accordance with the conventional manner.

EXAMPLES

The present invention will be described based on examples but embodiments of the invention are by no means limited to these.

Example 1

Preparation of Silver Halide Color Photographic Material

Preparation of Sample 101

On a 96 $\mu$m thick, subbed polyethyleneterephthalate film support, the following layers having composition as shown below were formed to prepare a multi-layered color photographic material sample 101. The ISO speed of sample 101, which was determined in accordance with the method of ANSI PH2.27 was 400. The addition amount of each compound was represented in term of g/m$^2$, unless otherwise noted. The amount of silver halide or colloidal silver was converted to the silver amount and the amount of a sensitizing dye (denoted as "SD") was represented in mol/Ag mol.

| | |
|---|---|
| 1st Layer: Anti-Halation Layer | |
| Black colloidal silver | 0.16 |
| UV-1 | 0.30 |
| CM-1 | 0.12 |
| OIL-1 | 0.24 |
| Gelatin | 1.33 |
| 2nd Layer: Interlayer | |
| Silver iodobromide emulsion i | 0.06 |
| AS-1 | 0.12 |
| OIL-1 | 0.15 |
| Gelatin | 0.67 |
| 3rd Layer: Low-speed Red-Sensitive Layer | |
| Silver iodobromide emulsion h | 0.19 |
| Silver iodobromide emulsion e | 0.17 |
| SD-1 | $2.22 \times 10^{-4}$ |
| SD-2 | $3.72 \times 10^{-5}$ |
| SD-3 | $1.56 \times 10^{-4}$ |
| SD-4 | $3.41 \times 10^{-4}$ |
| C-1 | 0.77 |
| CC-1 | 0.006 |
| OIL-2 | 0.47 |
| AS-2 | 0.002 |
| Gelatin | 1.82 |
| 4th Layer: Medium-speed Red-sensitive Layer | |
| Silver iodobromide emulsion b | 0.41 |
| Silver iodobromide emulsion h | 0.19 |
| SD-1 | $3.46 \times 10^{-4}$ |
| SD-2 | $2.44 \times 10^{-5}$ |
| SD-4 | $3.69 \times 10^{-4}$ |
| C-1 | 0.42 |
| CC-1 | 0.072 |
| DI-1 | 0.046 |
| OIL-2 | 0.27 |
| AS-2 | 0.003 |
| Gelatin | 1.45 |
| 5th Layer: High-speed Red-Sensitive Layer | |
| Silver iodobromide emulsion a | 0.63 |
| Silver iodobromide emulsion e | 0.07 |
| SD-2 | $1.35 \times 10^{-5}$ |
| SD-12 | $2.43 \times 10^{-4}$ |
| SD-4 | $6.45 \times 10^{-5}$ |
| C-2 | 0.10 |

-continued

| | |
|---|---|
| C-3 | 0.17 |
| CC-1 | 0.013 |
| DI-5 | 0.024 |
| DI-4 | 0.022 |
| DI-6 | 0.010 |
| OIL-2 | 0.17 |
| AS-2 | 0.004 |
| Gelatin | 1.40 |
| 6th Layer: Interlayer | |
| Y-1 | 0.08 |
| AS-1 | 0.11 |
| OIL-1 | 0.17 |
| X-2 | 0.005 |
| Gelatin | 0.87 |
| 7th Layer: Low-speed Green-Sensitive Layer | |
| Silver iodobromide emulsion h | 0.17 |
| Silver iodobromide emulsion e | 0.071 |
| SD-14 | $3.6 \times 10^{-5}$ |
| SD-15 | $4.2 \times 10^{-4}$ |
| M-1 | 0.375 |
| CM-1 | 0.042 |
| DI-2 | 0.010 |
| OIL-1 | 0.41 |
| AS-2 | 0.002 |
| AS-3 | 0.11 |
| Gelatin | 1.21 |
| 8th Layer: Medium-speed Green-Sensitive Layer | |
| Silver iodobromide emulsion b | 0.32 |
| Silver iodobromide emulsion h | 0.07 |
| SD-13 | $3.7 \times 10^{-4}$ |
| SD-6 | $3.44 \times 10^{-4}$ |
| SD-8 | $1.05 \times 10^{-4}$ |
| M-1 | 0.18 |
| CM-1 | 0.042 |
| CM-2 | 0.044 |
| DI-2 | 0.026 |
| DI-3 | 0.003 |
| OIL-1 | 0.23 |
| AS-3 | 0.046 |
| AS-4 | 0.006 |
| Gelatin | 1.01 |
| 9th Layer: High-speed Green-Sensitive Layer | |
| Silver iodobromide emulsion a | 0.71 |
| Silver iodobromide emulsion e | 0.07 |
| SD-13 | $8.0 \times 10^{-5}$ |
| SD-6 | $3.42 \times 10^{-4}$ |
| SD-8 | $1.04 \times 10^{-4}$ |
| M-1 | 0.038 |
| M-2 | 0.078 |
| CM-2 | 0.010 |
| DI-3 | 0.003 |
| OIL-1 | 0.20 |
| AS-2 | 0.007 |
| AS-3 | 0.035 |
| Gelatin | 1.03 |
| 10th Layer: Yellow Filter Layer | |
| Yellow colloidal silver | 0.053 |
| AS-1 | 0.15 |
| OIL-1 | 0.15 |
| Gelatin | 0.75 |
| 11th Layer: Low-speed Blue-sensitive Layer | |
| Silver iodobromide emulsion g | 0.19 |
| Silver iodobromide emulsion e | 0.18 |
| SD-9 | $1.14 \times 10^{-4}$ |
| SD-10 | $1.62 \times 10^{-4}$ |
| SD-11 | $4.39 \times 10^{-4}$ |
| Y-1 | 0.90 |
| DI-3 | 0.002 |
| OIL-1 | 0.29 |
| AS-2 | 0.X – 1 |
| 0.10 | |
| Gelatin | 1.49 |

-continued

| | |
|---|---|
| 12th Layer: High-sped Blue-sensitive Layer | |
| Silver iodobromide emulsion f | 0.71 |
| Silver iodobromide emulsion g | 0.20 |
| SD-9 | $4.11 \times 10^{-5}$ |
| SD-10 | $1.95 \times 10^{-5}$ |
| SD-11 | $1.59 \times 10^{-4}$ |
| Y-1 | 0.33 |
| DI-5 | 0.12 |
| OIL-1 | 0.17 |
| AS-2 | 0.010 |
| X-1 | 0.098 |
| Gelatin | 1.05 |
| 13th Layer: First Protective Layer | |
| Silver iodobromide emulsion i | 0.20 |
| UV-1 | 0.11 |
| UV-2 | 0.055 |
| X-1 | 0.078 |
| Gelatin | 0.70 |
| 14th Layer: Second protective Layer | |
| PM-1 | 0.13 |
| PM-2 | 0.018 |
| WAX-1 | 0.021 |
| Gelatin | 0.55 |

Characteristics of silver iodobromide emulsions used in sample 101 are shown below, wherein the average grain size refers to an edge length of a cube having the same volume as that of the grain.

| Emulsion | Av. Grain Size (μm) | Av. Iodide Content (mol %) | Diameter/thickness Ratio |
|---|---|---|---|
| a | 1.00 | 3.2 | 7.0 |
| b | 0.70 | 3.3 | 6.5 |
| c | 0.30 | 1.9 | 5.5 |
| d | 0.45 | 4.0 | 6.0 |
| e | 0.27 | 2.0 | Cubic |
| f | 1.20 | 8.0 | 5.0 |
| g | 0.75 | 8.0 | 4.0 |
| h | 0.45 | 4.0 | 6.0 |
| i | 0.03 | 2.0 | 1.0 |

With regard to the foregoing emulsions, except for emulsion i, after adding the foregoing sensitizing dyes to each of the emulsions and ripening the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-1, SU-2 and SU-3; a dispersing aid SU-4; viscosity-adjusting agent V-1; stabilizer ST-1; two kinds polyvinyl pyrrolidone of weight-averaged molecular weights of 10,000 and 1.100,000 (AF-1, AF-2); calcium chloride; inhibitors AF-3, AF-4, AF-5, AF-6 and AF-7; hardener H-1; and antiseptic Ase-1.

Chemical structures for each of the compounds used in the forgoing sample are shown below.
Y-1
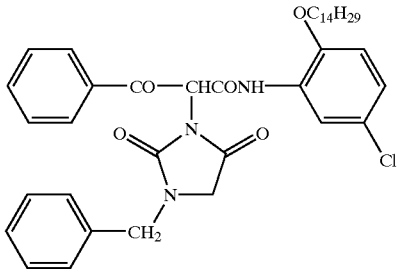
M-1
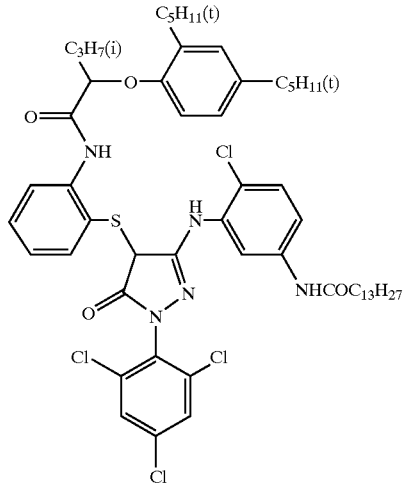
M-2
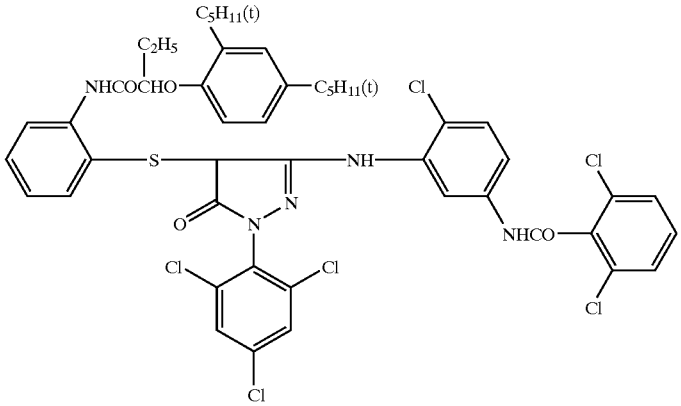
C-1
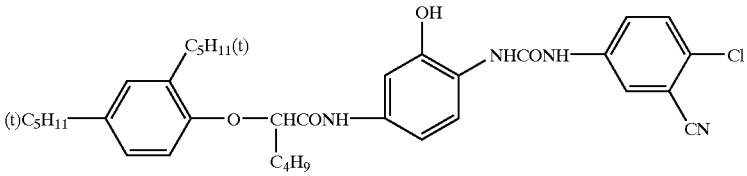
C-2
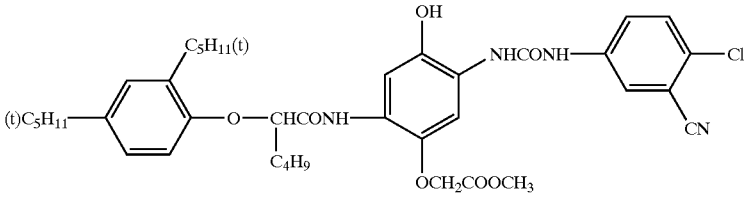

-continued
C-3
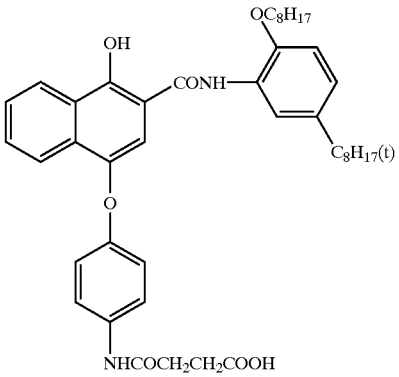
CC-1
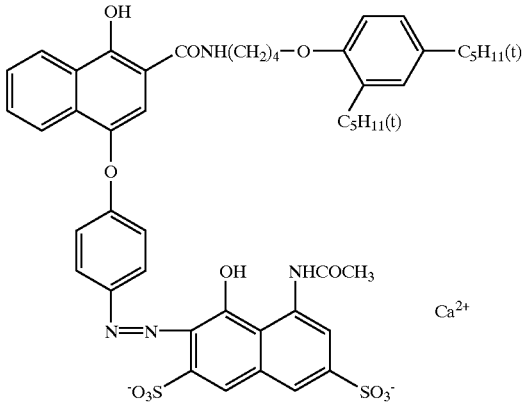
CM-1
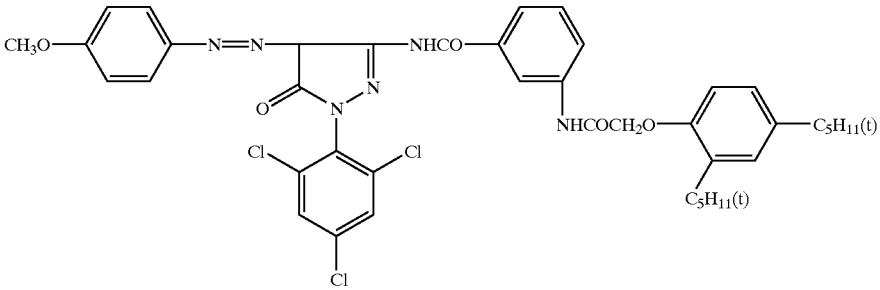
CM-2
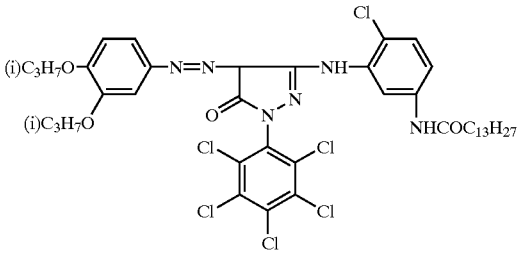
DI-1
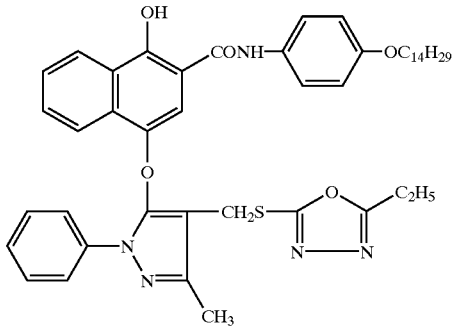
DI-2
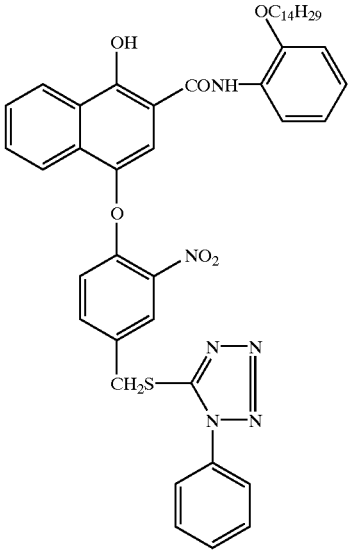
DI-3
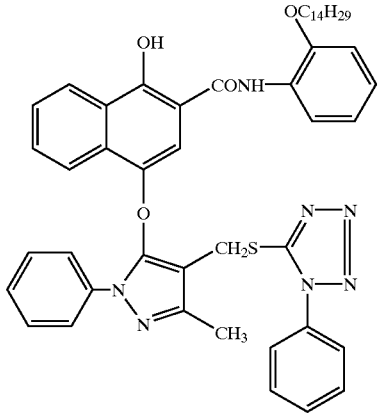

-continued
DI-4
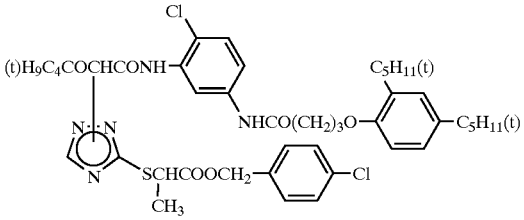
DI-5
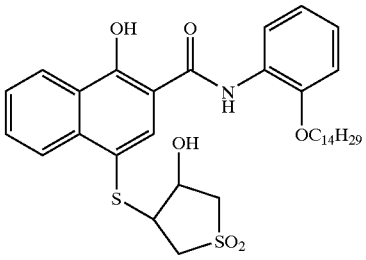
DI-6
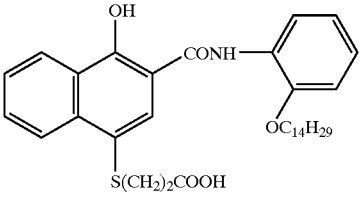
SD-1
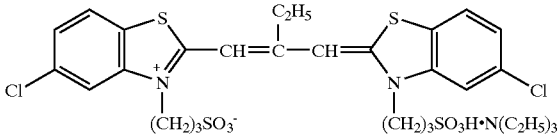
SD-2
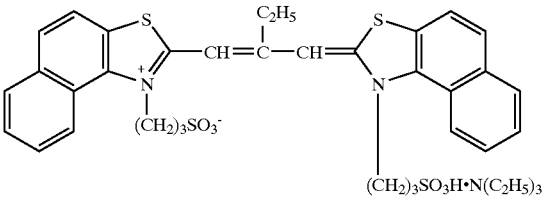
SD-3
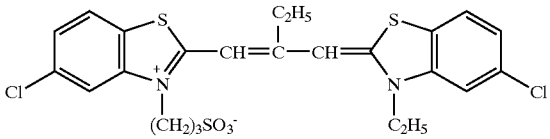
SD-4
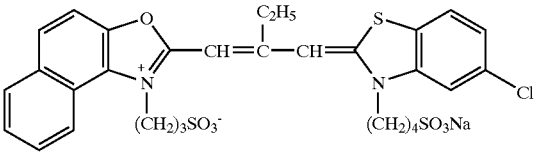
SD-6
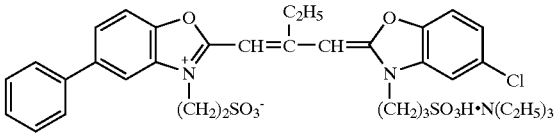
SD-8
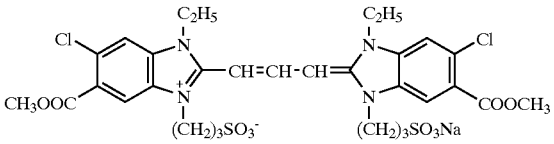
SD-9
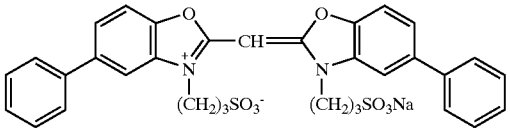
SD-10
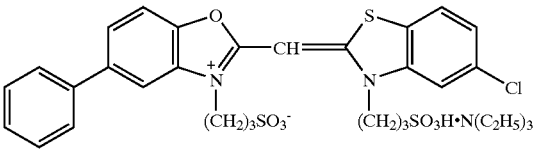
SD-11
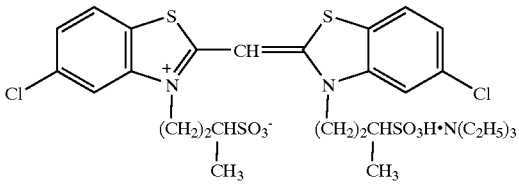
SD-12
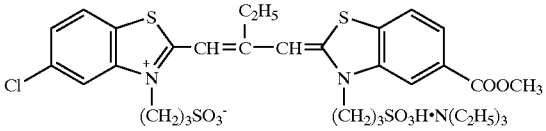
SD-13
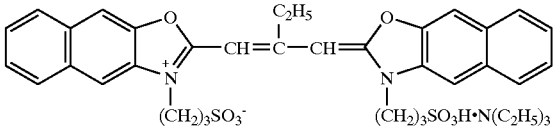

-continued
SD-14
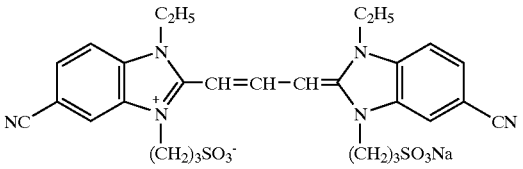
SD-15
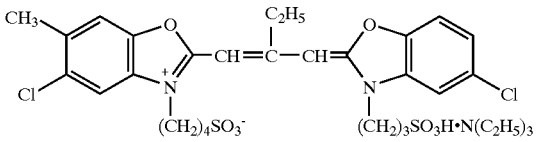
AS-1
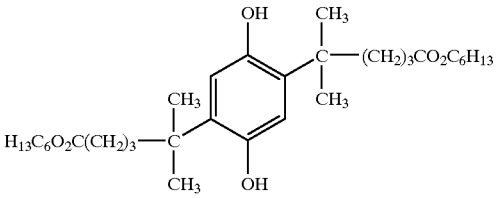
AS-2
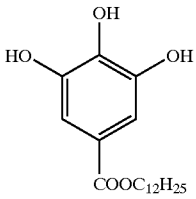
AS-3
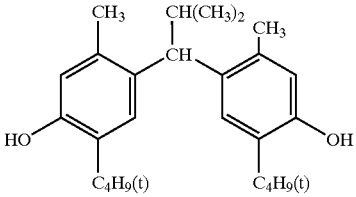
AS-4
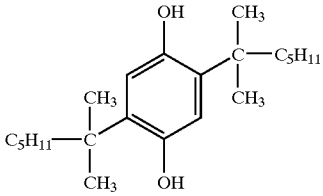
OIL-1
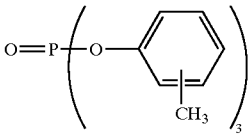
OIL-2
$H_9C_4OOC(CH_2)_8COOC_4H_9$
UV-1
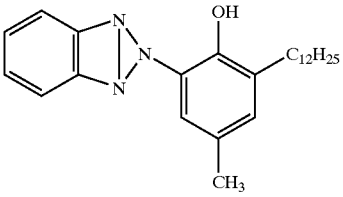
UV-2
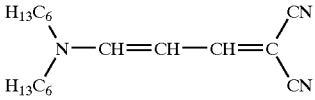
V-1
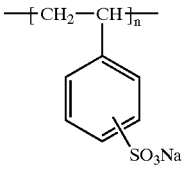
n: Degree of polymerization
Ase-1(Mixture)
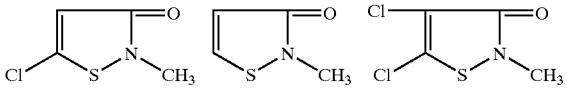
A B C
A:B:C = 50:46:4 (molar ratio)
H-1
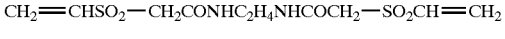
ST-1
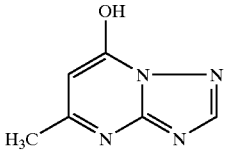
AF-1,2
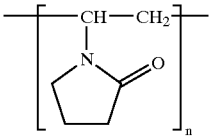
AF-1 Mw ≈ 10,000
AF-2 Mw ≈ 100,000
n: Degree of polymerization
AF-3
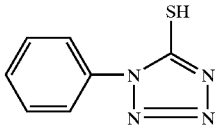

-continued

AF-4

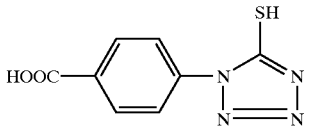

AF-5

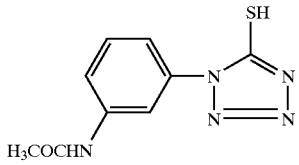

AF-6

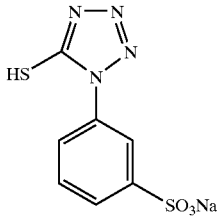

AF-7

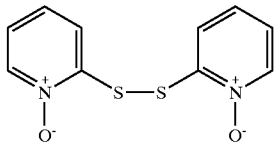

X-1

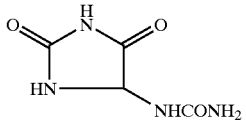

X-2

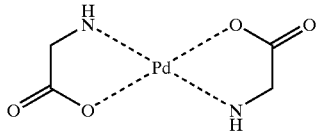

SU-1

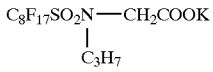

SU-2

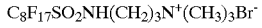

SU-3

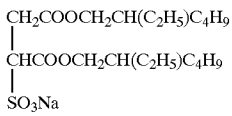

SU-4

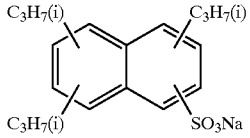

WAX-1

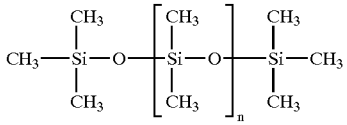

Mw = 3,000

PM-1

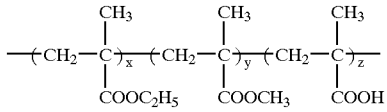

x:y:z = 3:3:4

PM-2

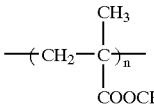

n: Degree of polymerization

Preparation of Sample 102

Sample 102 was prepared similarly to sample 101, except that amounts of silver iodobromide emulsions h and e of the 3rd layer were changed to 0.39 g/m$^2$ and 0.32 g/m$^2$, respectively; amounts of silver iodobromide emulsions b and h of the 4th layer were changed to 0.83 g/m$^2$ and 0.36 g/m$^2$, respectively; amounts of silver iodobromide emulsions a and e of the 5th layer were changed to 1.45 g/m$^2$ and 0.076 g/m$^2$, respectively; amounts of silver iodobromide emulsions h and e of the 7th layer were changed to 0.32 g/m$^2$ and 0.11 g/m$^2$, respectively; amounts of silver iodobromide emulsions b and h of the 8th layer were changed to 0.66 g/m$^2$ and 0.11 g/m$^2$, respectively; amounts of silver iodobromide emulsions a and e of the 9th layer were changed to 1.24 g/m$^2$ and 0.076 g/m$^2$, respectively; amounts of silver iodobromide emulsions g and e of the 11th layer were changed to 0.23 g/m$^2$ and 0.22 g/m$^2$, respectively; and amounts of silver iodobromide emulsions f and g of the 12th layer were changed to 1.34 g/m$^2$ and 0.25 g/m$^2$, respectively. The ISO speed of sample 102 was 1450.

Preparation of Sample 103

There were prepared emulsions Em-1 and Em-2 having characteristics described below, in accordance with preparation of emulsion EM-2 described in Examples of JP-A No.

2001-33903, provided that the pAg during grain formation and the addition time of the respective solutions were optimally adjusted. Further, these emulsion were subjected to prescribed chemical sensitization and spectral sensitization. Sample 103 was prepared similarly to sample 101, except that silver iodobromide emulsion a used in the 5th layer was replaced by an equivalent silver amount of emulsion Em-1, and silver iodobromide emulsion a used in the 9th layer and silver iodobromide emulsion f used in 12th layer were each replaced by an equivalent silver amount of emulsion Em-2. The ISO speed of sample 103 was 630.

The above-prepared emulsion Em-1 was a silver iodobromide emulsion comprised of hexagonal tabular grains having an average grain diameter of 2.8 μm, a grain diameter distribution (i.e., coefficient of variation of grain size distribution) of 18% and an average aspect ratio of 16. Electron microscopic observation revealed that 90% of the total grain projected area was accounted for by silver halide grains having at least 5 dislocation lines in the fringe portion and 70% of the total grain projected area was accounted for by silver halide grains having at least 20 dislocation lines in the fringe portion. Further, the emulsion Em-2 was a silver iodobromide emulsion comprised of hexagonal tabular grains having an average grain diameter of 3.5 μm, a grain diameter distribution of 20% and 50% of the total grain projected area was accounted for by tabular grains having an aspect ratio of 20. Electron microscopic observation revealed that 90% of the total grain projected area was accounted for by silver halide grains having at least 5 dislocation lines in the fringe portion and 70% of the total grain projected area was accounted for by silver halide grains having at least 20 dislocation lines in the fringe portion.

Preparation of Sample 104

Emulsions Em-3 (having an average grain thickness of 0.055 μm and an average grain diameter of 0.42 μm) and Em-4 (having an average grain thickness of 0.057 μm and an average grain diameter of 0.44 μm) were prepared in accordance with preparation of emulsion EM-2 described in Examples of JP-A No. 2001-33903. Further, these emulsion were subjected to prescribed chemical sensitization and spectral sensitization. Sample 104 was prepared similarly to sample 101, except that silver iodobromide emulsion a used in the 5th layer was replaced by an equivalent silver amount of emulsion Em-3, and silver iodobromide emulsion a used in the 9th layer and silver iodobromide emulsion f used in 12th layer were each replaced by an equivalent silver amount of emulsion Em-4. The ISO speed of sample 103 was proved to be 430.

Preparation of Sample 105

Sample 105 was prepared similarly to sample 104, except that the amount of emulsion Em-3 used in the 5th layer was changed to 1.24 g/m$^2$, the amount of emulsion Em-4 used in the 9th layer was changed to 1.34 g/m$^2$, the amount of C-3 used in the 5th layer was changed to 0.34 g/m$^2$, the amount of M-2 used in the 9th layer was changed to 0.20 g/m$^2$, and the amount of Y-1 used in the 12th layer was changed to 0.50 g/m$^2$. The ISO speed of sample 103 was proved to be 775.

Evaluation of Samples

The thus prepared samples 101 through 105 were each aged according to the procedure described below and evaluated with respect to the size of dye cloud, and minimum and maximum densities (also designated simply as Dmin and Dmax) and sensitivity (also designated simply as S) before or after subjected to accelerated aging test.

Process 101

Two parts of the respective samples were prepared. One part thereof was evaluated according to the following procedure. The other part was aged for two weeks at 55° C. and 65% RH and then evaluated as below.

Aged and unaged samples were exposed through an optical wedge for 1/100 sec. at 200 lux in accordance with the method as defined in ANSI PH2.27. After exposure, samples were processed according to the color negative standard process C-41 (Eastman Kodak Co.), in which color development was carried out at 35° C. for 195 sec. The thus processed samples were subjected to densitometry using a transmission type densitometer (produced by X-rite Co.) with red, green and blue lights to prepare characteristic curves comprised of abscissa-exposure (LogE) and ordinate-optical (D). From the thus prepared characteristic curve for each sample, the lowest and highest densities were determined. The difference when a base density was subtracted from the lowest density, and the difference when a base density was subtracted from the highest density were defined as the minimum density (Dmin) and the maximum density (Dmax), respectively. The sensitivity was defined by the reciprocal of exposure necessary to give a density of the minimum density plus 0.1 (i.e., Dmin+0.1). The sensitivity was represented by a relative value, based on the sensitivity of the unaged sample being 100.

The portion giving a density of Dmin+0.1 of each of the unaged samples was microscopically observed with respect to dye clouds and an average diameter of 500 dye clouds was determined.

The base density was determined as follows. Samples were processed in the same manner as the foregoing C-41 Process, except that only a color developing agent was removed from color developing solution. The obtained yellow, magenta and cyan densities (Y, M, C) were defined as base densities.

Process 102

Process 102 was conducted similarly to the foregoing process 101, except that the processing condition in the color development were varied from 38° C. and 195 sec. to 50° C. and 60 sec. Evaluation was made similarly to the process 101.

Process 103

Process 103 was conducted similarly to the foregoing process 101, except that the processing condition in the color development were varied from 38° C. and 195 sec. to 45° C. and 120 sec. Evaluation was made similarly to the process 101.

Of the foregoing evaluation results of samples 101 through 105, characteristic values of the green-sensitive layer (magenta dye image) are shown in Table 1.

TABLE 1

| Imaging No. | Photo-graphic Sample No. | Process No. | Magenta Dye Cloud Diameter (μm) | Unaged Sample Dmin | Unaged Sample Dmax | Unaged Sample S | Aged Sample Dmin | Aged Sample Dmax | Aged Sample S | Remark |
|---|---|---|---|---|---|---|---|---|---|---|
| 1-1 | 101 | 101 | 2.7 | 0.05 | 1.83 | 100 | 0.32 | 1.74 | 92 | Comp. |
| 1-2 | 103 | 101 | 2.8 | 0.19 | 1.79 | 100 | 0.40 | 1.60 | 89 | Comp. |
| 1-3 | 104 | 101 | 2.2 | 0.17 | 1.81 | 100 | 0.35 | 1.61 | 91 | Comp. |
| 1-4 | 105 | 101 | 2.7 | 0.20 | 1.84 | 100 | 0.37 | 1.68 | 93 | Comp. |
| 1-5 | 101 | 103 | 2.8 | 0.15 | 1.82 | 100 | 0.27 | 1.73 | 93 | Comp. |
| 1-6 | 102 | 101 | 3.1 | 0.22 | 1.81 | 100 | 0.29 | 1.75 | 91 | Comp. |
| 1-7 | 102 | 102 | 3.5 | 0.00 | 1.90 | 100 | 0.07 | 1.91 | 100 | Inv. |
| 1-8 | 103 | 102 | 3.9 | 0.01 | 1.95 | 100 | 0.10 | 1.97 | 101 | Inv. |
| 1-9 | 104 | 102 | 3.8 | 0.00 | 1.89 | 100 | 0.12 | 1.85 | 99 | Inv. |
| 1-10 | 105 | 102 | 3.2 | 0.01 | 1.92 | 100 | 0.09 | 1.91 | 99 | Inv. |
| 1-11 | 102 | 103 | 3.2 | 0.04 | 1.81 | 100 | 0.19 | 1.78 | 97 | Inv. |

As can be seen from Table 1, it was proved that the color image forming method relating to this invention, i.e., the combinations of the photographic material and the process relating to this invention achieved enhanced sensitivity, superior rapid processability and improved storage stability. Although not shown in Table 1, similar results were obtained with respect to yellow and magenta images.

Further, as a result of applying the reuse method described in JP-A No. 11-72891 to the processed samples described above, it was confirmed that silver and supports were properly recovered.

Example 2

Preparation of Silver Halide Color Photographic Material

Preparation of Sample 201

On a 96 μm thick, subbed polyethyleneterephthalate film support, the following layers having composition as shown below were formed to prepare a multi-layered color photographic material sample 201. The ISO speed of sample 101, which was determined in accordance with the method of ANSI PH2.27 was 250. The addition amount of each compound was represented in term of g/m$^2$, unless otherwise noted. The amount of silver halide or colloidal silver was converted to the silver amount and the amount of a sensitizing dye (denoted as "SD") was represented in mol/Ag mol. Silver iodobromide emulsions and additives used in sample 201 are similar to those used in samples 101, as shown earlier. Silver behenate was prepared in accordance with JP-A No. 2002-55410, paragraph No. 0096-0097, and ST-2 was further added thereto. The obtained silver behenate exhibited 28% monodispersibility (i.e., coefficient of grain size distribution).

| | |
|---|---|
| 1st Layer: Anti-Halation Layer | |
| Black colloidal silver | 0.16 |
| UV-1 | 0.30 |
| CM-1 | 0.12 |
| OIL-1 | 0.24 |
| AP-1 | 0.65 |
| Gelatin | 1.33 |
| 2nd Layer: Interlayer | |
| Silver iodobromide emulsion i | 0.06 |
| AS-1 | 0.12 |
| OIL-1 | 0.15 |
| DP-1 | 0.50 |
| Gelatin | 0.67 |

-continued

| | |
|---|---|
| 3rd Layer: Low-speed Red-Sensitive Layer | |
| Silver iodobromide emulsion h | 0.39 |
| Silver iodobromide emulsion e | 0.32 |
| SD-1 | $2.22 \times 10^{-4}$ |
| SD-2 | $3.72 \times 10^{-5}$ |
| SD-3 | $1.56 \times 10^{-4}$ |
| SD-4 | $3.41 \times 10^{-4}$ |
| C-1 | 0.77 |
| OIL-2 | 0.47 |
| AS-2 | 0.002 |
| Thermal solvent TS-1 | 0.23 |
| Silver behenate | 0.46 |
| Oxidizing agent OH-1 | 0.03 |
| Gelatin | 1.82 |
| 4th Layer: Medium-speed Red-sensitive Layer | |
| Silver iodobromide emulsion b | 0.83 |
| Silver iodobromide emulsion h | 0.36 |
| SD-1 | $3.46 \times 10^{-4}$ |
| SD-2 | $2.44 \times 10^{-5}$ |
| SD-4 | $3.69 \times 10^{-4}$ |
| C-1 | 0.42 |
| OIL-2 | 0.27 |
| AS-2 | 0.003 |
| Thermal solvent TS-1 | 0.28 |
| Silver behenate | 0.62 |
| Oxidizing agent OH-1 | 0.05 |
| Gelatin | 1.45 |
| 5th Layer: High-speed Red-Sensitive Layer | |
| Silver iodobromide emulsion a | 1.45 |
| Silver iodobromide emulsion e | 0.076 |
| SD-2 | $1.35 \times 10^{-5}$ |
| SD-12 | $2.43 \times 10^{-4}$ |
| SD-4 | $6.45 \times 10^{-5}$ |
| C-2 | 0.10 |
| C-3 | 0.17 |
| OIL-2 | 0.17 |
| AS-2 | 0.004 |
| Thermal solvent TS-1 | 0.33 |
| Silver behenate | 0.82 |
| Oxidizing agent OH-1 | 0.06 |
| Gelatin | 1.21 |
| 6th Layer: Interlayer | |
| Y-1 | 0.08 |
| AS-1 | 0.11 |
| OIL-1 | 0.17 |
| X-2 | 0.005 |
| DP-1 | 0.55 |
| Gelatin | 0.87 |
| 7th Layer: Low-speed Green-Sensitive Layer | |
| Silver iodobromide emulsion h | 0.32 |

-continued

| | |
|---|---|
| Silver iodobromide emulsion e | 0.11 |
| SD-14 | $3.6 \times 10^{-5}$ |
| SD-15 | $4.2 \times 10^{-4}$ |
| M-1 | 0.375 |
| OIL-1 | 0.41 |
| AS-2 | 0.02 |
| AS-3 | 0.11 |
| Thermal solvent TS-1 | 0.21 |
| Silver behenate | 0.43 |
| Oxidizing agent OH-1 | 0.03 |
| Gelatin | 1.21 |
| 8th Layer: Medium-speed Green-Sensitive Layer | |
| Silver iodobromide emulsion b | 0.66 |
| Silver iodobromide emulsion h | 0.11 |
| SD-13 | $3.7 \times 10^{-4}$ |
| SD-6 | $3.44 \times 10^{-4}$ |
| SD-8 | $1.05 \times 10^{-4}$ |
| M-1 | 0.18 |
| OIL-1 | 0.23 |
| AS-3 | 0.046 |
| AS-4 | 0.006 |
| Thermal solvent TS-1 | 0.23 |
| Silver behenate | 0.39 |
| Oxidizing agent OH-1 | 0.04 |
| Gelatin | 1.01 |
| 9th Layer: High-speed Green-Sensitive Layer | |
| Silver iodobromide emulsion a | 1.24 |
| Silver iodobromide emulsion e | 0.076 |
| SD-13 | $8.0 \times 10^{-5}$ |
| SD-6 | $3.42 \times 10^{-4}$ |
| SD-8 | $1.04 \times 10^{-4}$ |
| M-1 | 0.038 |
| M-2 | 0.078 |
| OIL-1 | 0.20 |
| AS-2 | 0.007 |
| AS-3 | 0.035 |
| Thermal solvent TS-1 | 0.38 |
| Silver behenate | 0.41 |
| Oxidizing agent OH-1 | 0.03 |
| Gelatin | 1.03 |
| 10th Layer: Yellow Filter Layer | |
| Yellow colloidal silver | 0.053 |
| AS-1 | 0.15 |
| OIL-1 | 0.18 |
| DP-1 | 0.42 |
| Gelatin | 0.75 |
| 11th Layer: Low-speed Blue-sensitive Layer | |
| Silver iodobromide emulsion g | 0.23 |
| Silver iodobromide emulsion e | 0.22 |
| SD-9 | $1.14 \times 10^{-4}$ |
| SD-10 | $1.62 \times 10^{-4}$ |
| SD-11 | $4.39 \times 10^{-4}$ |
| Y-1 | 0.90 |
| OIL-1 | 0.29 |
| AS-2 | 0.014 |
| X-1 | 0.10 |
| Thermal solvent TS-1 | 0.28 |
| Silver behenate | 0.29 |
| Oxidizing agent OH-1 | 0.02 |
| Gelatin | 1.49 |
| 12th Layer: High-sped Blue-sensitive Layer | |
| Silver iodobromide emulsion f | 1.34 |
| Silver iodobromide emulsion g | 0.25 |
| SD-9 | $4.11 \times 10^{-5}$ |
| SD-10 | $1.95 \times 10^{-5}$ |
| SD-11 | $1.59 \times 10^{-4}$ |
| Y-1 | 0.33 |
| OIL-1 | 0.17 |
| AS-2 | 0.010 |
| Thermal solvent TS-1 | 0.41 |
| Silver behenate | 0.33 |
| Oxidizing agent OH-1 | 0.04 |
| Gelatin | 1.05 |

-continued

| | |
|---|---|
| 13th Layer: First Protective Layer | |
| Silver iodobromide emulsion i | 0.20 |
| UV-1 | 0.11 |
| UV-2 | 0.055 |
| X-1 | 0.078 |
| Gelatin | 0.70 |
| 14th Layer: Second protective Layer | |
| PM-1 | 0.13 |
| PM-2 | 0.018 |
| WAX-1 | 0.021 |
| Gelatin | 0.55 |

Preparation of Sample 202

Sample 202 was prepared similarly to sample 201, except that gelatin amounts of the 3rd, 4th, 5th, 7th, 8th, 9th, 11th and 12th layers were varied to 0.7 times each of those.

Preparation of Sample 203 through 207

Samples 203 through 207 were prepared similarly to sample 202, except that DP-1 used in the $2^{nd}$ and $10^{th}$ layers was replaced by an equimolar amount of CDP-1, CDP-2, CDP-3, CDP-4, and CDP-5, respectively.

Preparation of Sample 208

Sample 208 was prepared similarly to Sample 201, except that 0.21 g/m$^2$ of 4-methylphthalic acid and 0.43 g/m$^2$ of phthalazinone were incorporated to each of the 5th, 9th and 12th layers.

Preparation of Sample 209

Sample 209 was prepared similarly to Sample 201, except that ET-1 was incorporated to each of the 5th, 9th and 12th layers, in an amount of 0.1 mol % of silver of the respective layer.

Preparation of Sample 210

Sample 210 was prepared similarly to Sample 201, except that HD-1 was incorporated to each of the 5th, 9th and 12th layers, in an amount of 0.2 mol % of silver of the respective layer.

Preparation of Sample 211

Sample 211 was prepared similarly to sample 201, except that the preparation process of was varied so that the monodispersibility is 8%.

Preparation of Sample 212

Sample 212 was prepared similarly to Sample 201, except that C-1, C-2 and C-3 used in the 3rd, 4th and 5th layers were each replaced by an equimolar amount of C-6 described in JP-B No. 6-64319; M-1 and M-2 used in the 7th, 8th and 9th layers were replaced by an equimolar amount of MM-2 described in the foregoing publication; Y-1 used in the 11th and 12th layers were replaced by an equimolar amount of Y-3 described in the foregoing publication, and each of the foregoing was incorporated similarly to the method described in the foregoing publication.

Preparation of Sample 213

Sample 261 was prepared similarly to Sample 201, except that CDS-1 was incorporated to each of the 5th, 9th and 12th layers, in an amount of the coupler of the respective layer.

Compounds used in the foregoing samples are shown below, except for those in Example 1.

AP-1
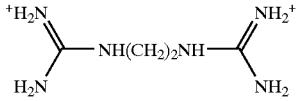
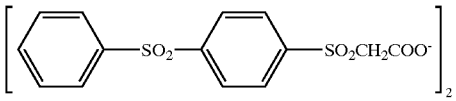
CDP-5
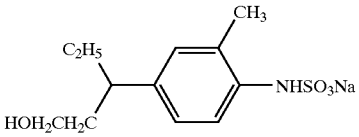
TS-1
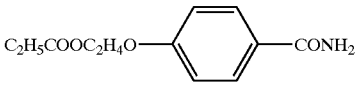
ST-2
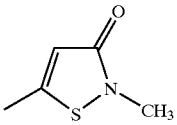
OH-1
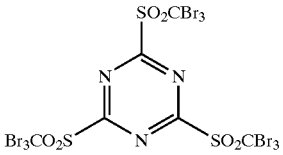
CDP-1
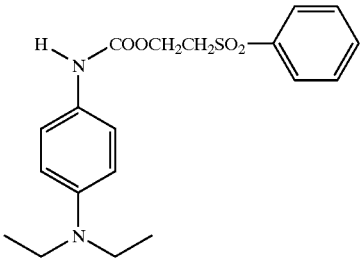
CDP-2
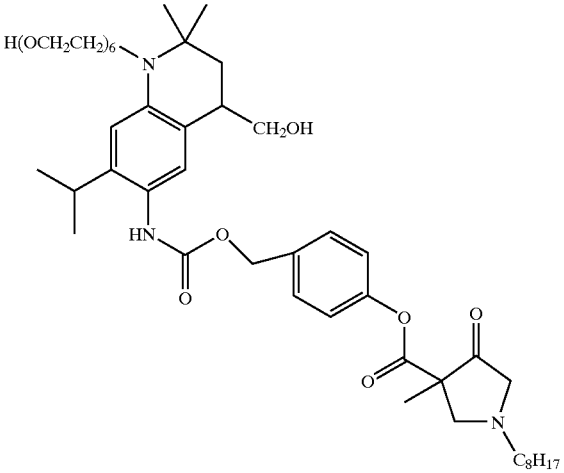
-continued
CDP-3
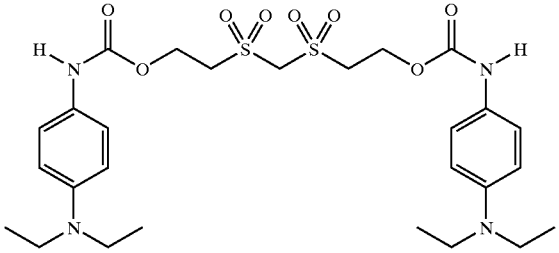
CDP-4
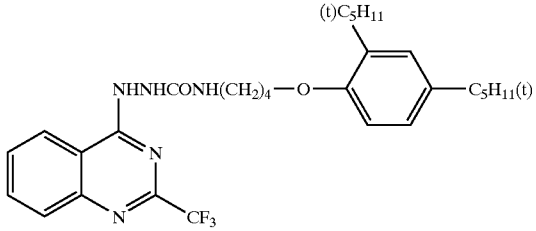
DP-1
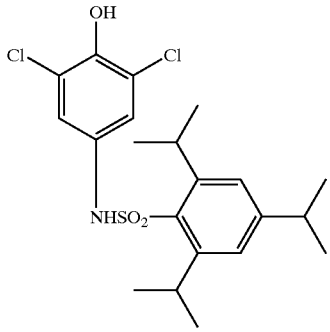
ET-1
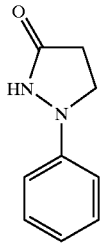
HD-1
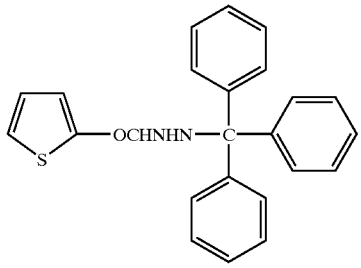
CDS-1
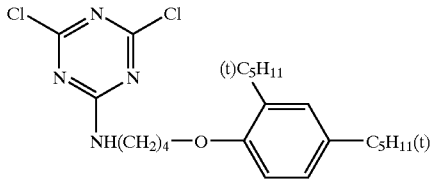

Evaluation of Samples

The thus prepared samples 201 through 213 were each processed according to the procedure described below and evaluated with respect to dye cloud size, and minimum and maximum densities (Dmin and Dmax) and sensitivity (S) before or after subjected to accelerated aging test.

Two parts of the respective samples 201 to 213 were prepared. One part thereof was evaluated according to the following procedure. The other part was aged for two weeks at 55° C. and 65% RH and then evaluated as below.

Aged and unaged samples were exposed through an optical wedge for 1/100 sec. at 200 lux in accordance with the method as defined in ANSI PH2.27. After exposure, samples were each heated at 120° C. for 30 sec. After heating, the samples were each subjected to bleaching, fixing and stabilizing, according to the color negative standard process C-41 (Eastman Kodak Co.). This process is denoted as process 201. The thus processed samples were subjected to densitometry using a transmission type densitometer (produced by X-rite Co.) with red, green and blue lights to prepare characteristic curves comprised of abscissa-exposure (LogE) and ordinate-optical (D). From the thus prepared characteristic curve for each sample, the lowest and highest densities were determined. The difference when a base density was subtracted from the lowest density, and the difference when a base density was subtracted from the highest density were defined as the minimum density (Dmin) and the maximum density (Dmax), respectively. The sensitivity was defined by the reciprocal of exposure necessary to give a density of the minimum density plus 0.1 (i.e., Dmin+0.1). The sensitivity was represented by a relative value, based on the sensitivity of the unaged sample being 100.

The portion giving a density of Dmin+0.1 was microscopically observed with respect to dye clouds and an average diameter of 500 dye clouds was determined.

Of the foregoing evaluation results of the samples, characteristic values of the green-sensitive layer (magenta dye image) are shown in Table 2.

TABLE 2

| Imaging | Photo-graphic Sample | Process | Magenta Dye Cloud Diameter | Unaged Sample | | | Aged Sample | | | |
|---|---|---|---|---|---|---|---|---|---|---|
| No. | No. | No. | (μm) | Dmin | Dmax | S | Dmin | Dmax | S | Remark |
| 2-1 | 201 | 201 | 0.8 | 0.19 | 1.73 | 100 | 0.53 | 1.55 | 89 | Comp. |
| 2-2 | 202 | 201 | 3.3 | 0.02 | 1.92 | 100 | 0.19 | 1.90 | 97 | Inv. |
| 2-3 | 203 | 201 | 4.3 | 0.00 | 1.93 | 100 | 0.10 | 1.92 | 100 | Inv. |
| 2-4 | 204 | 201 | 3.9 | 0.01 | 1.90 | 100 | 0.11 | 1.91 | 99 | Inv. |
| 2-5 | 205 | 201 | 4.2 | 0.02 | 1.91 | 100 | 0.12 | 1.89 | 98 | Inv. |
| 2-6 | 206 | 201 | 3.4 | 0.09 | 1.84 | 100 | 0.20 | 1.80 | 97 | Inv. |
| 2-7 | 207 | 201 | 3.3 | 0.02 | 1.90 | 100 | 0.09 | 1.91 | 99 | Inv. |
| 2-8 | 208 | 201 | 3.5 | 0.07 | 1.88 | 100 | 0.21 | 1.88 | 97 | Inv. |
| 2-9 | 209 | 201 | 4.1 | 0.08 | 1.85 | 100 | 0.18 | 1.80 | 95 | Inv. |
| 2-10 | 210 | 201 | 3.8 | 0.05 | 1.87 | 100 | 0.22 | 1.85 | 96 | Inv. |
| 2-11 | 211 | 201 | 4.3 | 0.09 | 1.88 | 100 | 0.15 | 1.90 | 97 | Inv. |
| 2-12 | 212 | 201 | 3.2 | 0.02 | 1.85 | 100 | 0.14 | 1.83 | 99 | Inv. |
| 2-13 | 213 | 201 | 6.7 | 0.04 | 1.89 | 100 | 0.08 | 1.88 | 99 | Inv. |

As can be seen from Table 2, it was proved that of photothermographic materials including a color developing agent, samples comprising constitution relating to the invention led to the color image forming method exhibiting enhanced sensitivity, superior rapid processability and improved storage stability. Although not shown in Table 1, similar results were obtained with respect to yellow and magenta images.

Further, as a result of applying the reuse method described in JP-A No. 11-72891 to the processed samples described above, it was confirmed that silver and supports were properly recovered.

Example 3

Photographic samples prepared in Examples 1 and 2 were each converted in accordance with the 135 size film standard and packed in a cartridge. Using these film samples and a single-lens reflex camera provided with lens of 35 mm focal length and F:2 (F4, product by Nikon Corp.), five scenes including people, flowers, greenish plants, far mountains and blue sky were photographed, setting the ISO speed to be 800. Thereafter, the exposed film samples were subjected to color development according to the method described in Examples 1 and 2, without further subjecting to bleaching, fixing and stabilizing processes to obtain developed samples in which developed silver and silver halide remained. From the thus developed film, R, G and B separation negative images were obtained using a monochromatic CCD camera of 2048×2048 pixels (KX4, available from Eastman Kodak Co.), in which a red separation filter (gelatin filter No. W26, available from Eastman Kodak Co.), a green separation filter (No. W99) or a blue separation filter (No. W98) was arranged between the light source and film. The thus obtained RGB image data were outputted onto Konica color paper type QAA7 of A4-size (210 mm×297 mm) and 2 L-size (127 mm×178 mm) to obtain color prints, using LED printer (available from Konica Corp.).

10 persons with respect to sharpness and granular appearance of images, vividness of greenish plants and apparent depth of mountains subjected the thus obtained color prints to sensory tests. As a result, it was proved that the color prints that were prepared using samples obtained by the process relating to this invention were by no means inferior to images obtained in the conventional photography system.

Example 4

Samples used in Example 3 were developed, and then further subjected to bleaching, fixing and stabilizing processes in accordance with the C41 standard process. The thus processed samples were evaluated similarly to example 3. As a result, it was proved that obtained prints were by no means inferior to images obtained in the conventional photography system.

Example 5

Samples used in Example 3 were developed and read using a CCD camera. Then, developed samples were further subjected to bleaching, fixing and stabilizing processes in accordance with the C41 standard process. Thereafter, similarly to Example 3, the processed samples were read with the CCD camera and from the obtained R, G and B separation negative images, color prints were prepared, which were proved to be by no means inferior to images obtained in the conventional photography system.

Example 6

Samples were processed and evaluated similarly to Example 3, provided that when the processed samples were read with the CCD camera, an image correction treatment was conducted based on infrared light transmitted through the photographic material sample, in accordance with the method described in JP-A No. 6-28468. As a result, it was proved to be by no means inferior or be superior to images obtained in the conventional photography system. Similar results were also obtained when correction was made using infrared reflection light.

Example 7

Processing and evaluation were conducted similarly to Example 1, except that color development was carried out using the processing element described in Examples 1 of JP-A No. 2002-55418. Similarly to Example 1, it was proved that this invention provided a color image forming method achieving enhanced sensitivity and superior storage stability.

What is claimed is:

1. A method of forming a color image comprising the steps of:

imagewise exposing a silver halide color photographic material comprising a support having thereon at least one silver halide light-sensitive layer containing silver halide grains and a dye-forming coupler and at least one light-insensitive layer and developing the exposed photographic material at a developing temperature of 43 to 180° C. to form a color image, wherein when the photographic material is exposed so that the developed light-sensitive layer has a transmission density of a minimum density plus 0.1, the developed light-sensitive layer comprises dye-clouds having an average diameter of 3.0 to 20.0 $\mu$m.

2. The method of claim 1, wherein the developing temperature is 50 to 160° C.

3. The method of claim 1, wherein the light-sensitive layer is one selected from the group consisting of a blue-sensitive layer containing blue-sensitive silver halide grains and a yellow dye forming coupler, a green-sensitive layer containing green-sensitive silver halide grains a magenta dye-forming coupler and a red-sensitive layer containing red-sensitive silver halide grains and a cyan dye-forming layer.

4. The method of claim 1, wherein the photographic material has an ISO speed of not less than 800.

5. The method of claim 1, wherein the silver halide grains are comprised of tabular grains having an average aspect ratio of not less than 8.

6. The method of claim 5, wherein the tabular grains have an average thickness of 0.01 to 0.07 $\mu$m.

7. The method of claim 1, wherein at least one of the light-sensitive layer and the light-insensitive layer contains a color developing agent or its precursor.

8. The method of claim 7, wherein the precursor is a compound capable of releasing a p-phenylenediamine type color developing agent.

9. The method of claim 1, wherein at least one of the light-sensitive layer and the light-insensitive layer contains an image tone modifier.

10. The method of claim 1, wherein at least one of the light-sensitive layer and the light-insensitive layer contains an electron transfer agent.

11. The method of claim 1, wherein at least one of the light-sensitive layer and the light-insensitive layer contains a hydrazine derivative.

12. The method of claim 1, wherein the light-sensitive layer contains an organic silver salt grains exhibiting a coefficient of variation of grain size of 0.1 to 25%.

13. The method of claim 1, wherein the dye-forming coupler is a Fisher type coupler.

14. The method of claim 1, wherein the light-sensitive layer contains a compound capable of forming a substantially colorless compound upon reaction with an oxidation product of a color developing agent.

15. A method of forming a color image comprising the steps of:

(a) imagewise exposing a silver halide color photographic material comprising a support having thereon at least one silver halide light-sensitive layer containing silver halide grains and a dye-forming coupler and at least one light-insensitive layer, (b) developing the exposed photographic material at a temperature of 43 to 180° C. to form a color image, (c) converting information of the formed color image to digital image information through an image sensor, wherein when the photographic material is exposed so that the developed light-sensitive layer has a transmission density of a minimum density plus 0.1, the developed light-sensitive layer comprises dye-clouds having an average diameter of 3.0 to 20.0 $\mu$m.

16. The method of claim 15, wherein in step (c), reflection light from the photographic material is used.

17. The method of claim 15, wherein in step (c), infrared light is used.

18. The method of claim 15, wherein step (c) is performed without removing a silver halide or a light-insensitive silver compound contained in the photographic material.

19. The method of claim 15, wherein prior to step (c), the method further comprises the steps of:

(b') subjected the photographic material which has been subjected to the color development to at least one selected from the group of bleach, fixation and stabilization to obtain a color image.

20. A method of forming a color image comprising the steps of:

(a) imagewise exposing a silver halide color photographic material comprising a support having thereon at least one silver halide light-sensitive layer containing silver halide grains and a dye-forming coupler and at least one light-insensitive layer, (b) developing the exposed photographic material at a temperature of 43 to 180° C. to form a color image, (c) converting information of the formed color image to digital image information through an image sensor, wherein when the photographic material is exposed so that the developed light-sensitive layer has a transmission density of a minimum density plus 0.1, the developed light-sensitive layer comprises dye-clouds having an average diameter of 3.0 to 20.0 μm, and step (c) is performed without removing a silver halide or a light-insensitive silver compound contained in the photographic material;

and wherein the photographic material has an ISO speed of not less than 800, the silver halide grains are comprised of tabular grains having an average aspect ratio of not less than 8, the light-insensitive layer contains a color developing agent or its precursor, and the light-sensitive layer contains an organic silver salt grains exhibiting a coefficient of variation of grain size of 0.1 to 25%.

21. The method of claim 15, wherein the developing temperature is 50 to 160° C.

22. The method of claim 15, wherein the light-sensitive layer is one selected from the group consisting of a blue-sensitive layer containing blue-sensitive silver halide grains and a yellow dye forming coupler, a green-sensitive layer containing green-sensitive silver halide grains a magenta dye-forming coupler and a red-sensitive layer containing red-sensitive silver halide grains and a cyan dye-forming layer.

23. The method of claim 15, wherein the photographic material has an ISO speed of not less than 800.

24. The method of claim 15, wherein the silver halide grains are comprised of tabular grains having an average aspect ratio of not less than 8.

25. The method of claim 24, wherein the tabular grains have an average thickness of 0.01 to 0.07 μm.

26. The method of claim 15, wherein at least one of the light-sensitive layer and the light-insensitive layer contains a color developing agent or its precursor.

27. The method of claim 26, wherein the precursor is a compound capable of releasing a p-phenylenediamine type color developing agent.

28. The method of claim 15, wherein at least one of the light-sensitive layer and the light-insensitive layer contains an image tone modifier.

29. The method of claim 15, wherein at least one of the light-sensitive layer and the light-insensitive layer contains an electron transfer agent.

30. The method of claim 15, wherein at least one of the light-sensitive layer and the light-insensitive layer contains a hydrazine derivative.

31. The method of claim 15, wherein the light sensitive layer contains an organic silver salt grains exhibiting a coefficient of variation of grain size of 0.1 to 25%.

32. The method of claim 15, wherein the dye-forming coupler is a Fisher type coupler.

33. The method of claim 15, wherein the light-sensitive layer contains a compound capable of forming a substantially colorless compound upon reaction with an oxidation product of a color developing agent.

* * * * *